US008505595B2

(12) United States Patent
Bragg et al.

(10) Patent No.: US 8,505,595 B2
(45) Date of Patent: Aug. 13, 2013

(54) METHOD AND SYSTEM FOR CONTROLLING DRIPPINGS FROM A BEVERAGE DISPENSER VIA AN EXPANSION VALVE

(75) Inventors: John C. Bragg, Jeffersonville, IN (US); Harry Wing, Midland, MI (US); Nicholas M. Patterson, Odessa, FL (US); Roberto Nevarez, Hudson, FL (US); Paul Hanniffy, Louisville, KY (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 0 days.

(21) Appl. No.: 13/605,772

(22) Filed: Sep. 6, 2012

(65) Prior Publication Data

US 2013/0061981 A1 Mar. 14, 2013

Related U.S. Application Data

(60) Provisional application No. 61/531,562, filed on Sep. 6, 2011, provisional application No. 61/532,932, filed on Sep. 9, 2011.

(51) Int. Cl.

| | |
|---|---|
| ***B65B 1/04*** | (2006.01) |
| ***B65B 3/04*** | (2006.01) |
| ***B67D 1/16*** | (2006.01) |

(52) U.S. Cl.

USPC ..... 141/302; 141/9; 222/108

(58) Field of Classification Search

USPC ..... 141/9, 105, 301, 302; 251/5, 7, 251/61.1, 324; 137/112, 114; 222/1, 108, 222/129.1, 148, 526, 527, 528, 537, 571, 222/566

See application file for complete search history.

(56) References Cited

U.S. PATENT DOCUMENTS

| | | | | |
|---|---|---|---|---|
| 5,299,715 | A * | 4/1994 | Feldman | 222/129.1 |
| 6,857,543 | B2 * | 2/2005 | Kvam et al. | 222/571 |
| 2010/0323071 | A1 * | 12/2010 | Nevarez et al. | 426/231 |
| 2011/0168738 | A1 * | 7/2011 | Nevarez et al. | 222/129.1 |

OTHER PUBLICATIONS

International Search Report and Written Opinion dated Nov. 23, 2012 for corresponding International Patent Application No. PCT/US2012/053968.

* cited by examiner

*Primary Examiner* — Timothy L Maust
*Assistant Examiner* — Brandon J Warner
(74) *Attorney, Agent, or Firm* — Ohlandt, Greeley, Ruggiero and Perle, L.L.P.

(57) ABSTRACT

A beverage system includes an ingredient module and an ingredient dispensing valve dispensing an ingredient into a beverage container. The ingredient module comprises a housing, an ingredient container disposed within the housing, a first ingredient conduit disposed between the ingredient container and the ingredient dispensing valve, and a pumping device that causes the ingredient to move from the ingredient container, through the first ingredient conduit, and through the ingredient dispensing valve under pressure. A valve receives the ingredient from the pumping device and passes the ingredient to the dispensing valve. The valve includes a second ingredient conduit, where the valve controls the size of the second ingredient conduit, such that the size of the second ingredient conduit is reduced during dispensing of the ingredient to the dispensing valve and enlarged when the dispensing of the ingredient to the dispensing valve is terminated.

12 Claims, 45 Drawing Sheets

Product Mode

Idle -

| | | | | | |
|---|---|---|---|---|---|
| Display/Function | 1. Computer displays "Select Up to 3 Flavors"<br>2. Computer displays up to 7 flavors (configurable) selections located in line with selection soft key and a "Water Only" and "ICE Only" selection located above the right most bottom soft keys respectively. | | | | |
| Button | | Press 1-3 flavors OR Ice Only soft keys not cannot select both Ice Only and flavors | Press X to go to system setup | Press check without flavor selections | Pression more than 3 flavors |
| Display/Function | | Display highlights the flavors selected | Display un-highlight selections | Display does not change (stay in Idle) | Display reverse videos the first 3 and does not change unless the same item is selected in which case will toggle to un-select. |
| Botton | Press X to clear selections | Press check to select | | | |
| Dixplay/Function | — | 1. Computer displays "Additives and Cup Size"<br>2. Computer displays "Flavor: sel1, and sel3" below where sel1 - sel3 are the flavors previously selected.<br>3. Computer displays three additives available for selection below the top soft keys including Yogurt on the right top key. Note Computer displays additives crossed out if currently unavailable.<br>4. Computer displays four cup size selections "Small" above the bottom left key, "Medium" above the center bottom key, "Large" and "XLarge" above the bottom right most keys respectively. | — | — | — |
| | | | — | — | — |

Fig. 23

Product Mode

| | | | | | | | | |
|---|---|---|---|---|---|---|---|---|
| Button | — | Press X to go to previous Display | 1. Place cup under dispenser<br>2. If additive desired 1st select up to three additives<br>3. Press soft key under Small, Medium, Large, or XLarge - this starts the dispensing! | | Check is disabled | — | — | — |
| | | | | | — | — | — | — |
| Display/Function | — | — | Computer starts dispensing product and Computer displays "Dispensing" with display of cup size, flavors, and additives selected for duration of dispense cycle. | | | — | — | — |
| Botton | — | — | X goes back to Idle and stop dispensing | | — | — | — | — |
| Dixplay/Function | — | — | 1. Computer displays "Select Mixer" and "left" under the left most top soft key and "Right" under the right most top soft key for a two dispenser unit.<br>2. Computer will display "LEFTL" and "RIGHTL" and "RIGHTR" under the two right most soft keys if this system is configured with four dispenser modules.<br>3. If any of the mixers are busy or not functional the computer will display the appropriate left or right text crossed out. | | — | — | — | — |
| Botton | — | — | Press X to go back to Idle, Check is disabled | 1.Press Soft key above available mixer (not crossed out), then computer goes back to idle display.<br>2. Open blender door.<br>3. Place cup and close door<br>4. Computer starts blending with door closure.<br>5. Blending completes (no beep?) then user removes cup and door should close to allow cleaning cycle. | — | — | — | — |

Fig. 24

| System Setup Mode | | | | | | | | | |
|---|---|---|---|---|---|---|---|---|---|
| Botton | From Idle Press X | | | | | | | | |
| Display/Function | Computer displays "System Setup" with "DISP. Setup", "LOAD Fluids", and "Service" displayed under the the top left, center and right soft keys. | | | | | | | | |
| Botton | Press appropriate soft key (DISP Setup, LOAD FLUIDS, or Service)<br>Note other soft keys are disabled | | | | | | | Press X to go back to Idle Mode | Check disabled ? |
| Display/Function | If DISP Setup was selected then the Computer displays "Brightness" on the left and "Contrast" on the right with + and - symbols on each side above and below the associated soft keys. | | If LOAD Fluids was selected then the Computer displays "Load Fluids" with "Slot 1", "Slot 2", "Slot 3", "Slot 4", and "Slot 5" across the top of the display respectively and "Slot 6" and "Slot 7" across the bottom left of the display respectively. | | If Service was selected then the Computer displays "Status", "Calibrate", "Maint". | | | — | — |
| Botton | Press X or Check to go back to Setup screen | Press appropriate soft keys to modify brightness and Contrast | Press one of the slot slections | Press X or Check to go back to Setup screen | If Status pressed | If Calibrate is pressed | If Maint. Pressed | — | — |
| Display/Function | — | Press X or Check to go back to service screen? | 1. Computer displays "Assign Fluid Slot X" on the left side of the display where x is the slot number selected previously.<br>2. Computer displays list of up to 255? Fluid selections with current fluid highlighted with up down arrows under the top and bottom right most soft keys respectively. | — | Computer displays?<br>1. Temp sensor Values.<br>2. Error log.<br>3. # of cycles of each product.<br>4. | Fluid calibration needed? | 1. Cleaning?<br>2. Dispensing cleaning fluid?<br>3. Cycle through modes for service testing? | — | — |

Fig. 25a

| System Setup Mode | | | | | | | | | | |
|---|---|---|---|---|---|---|---|---|---|---|
| Botton | — | — | Scroll through product using soft keys and select highlighted fluid by pressing check. Soft keys disabled? Goes back to Load Fluids screen? Primes pump? | Press X to go back to Load Fluids screen | — | — | — | — | — | — |

| Language Botton | |
|---|---|
| Botton | Press language key at any time |
| Display/Function | Current display changes to a new language each time the button is pressed. When starting English the display changes to the languages and order below:<br>1. Spanish, 2. French, 4. Canadian, 5. German, 6. Swedish, 7. Portuguese, 8. Italian, 9. Chinese, 10. Japanese, 11. back to English |

Fig. 25b

METHOD AND SYSTEM FOR CONTROLLING DRIPPINGS FROM A BEVERAGE DISPENSER VIA AN EXPANSION VALVE

CROSS-REFERENCED APPLICATIONS

This application claims priority to U.S. Provisional Application No. 61/531,562, filed on Sep. 6, 2011, and U.S. Provisional Application No. 61/532,932, filed on Sep. 9, 2011. U.S. Provisional Application No. 61/531,562, filed on Sep. 6, 2011, and U.S. Provisional Application No. 61/532,932, filed on Sep. 9, 2011 are incorporated herein in their entirety by reference thereto.

BACKGROUND OF THE DISCLOSURE

1. Field of the Disclosure

The present disclosure relates generally to an integrated method and system for dispensing and blending/mixing beverage flavor/ingredients, thereby producing a beverage, e.g., a smoothie. More particularly, the present disclosure relates to a system and method for storing the flavor/ingredients, and dispensing the same. The present disclosure also relates to a system and method for cleaning the flavor/ingredient dispensing system in place.

2. Description of Related Art

Multiple steps are involved in creating a beverage or drink, for example, a smoothie drink, from beginning to end, and potential issues can occur at all stages. After ice is added to a blender pot for mixing the beverage, juice and any additional fruit or flavor "mix-in" is added by an operator as well. A size of cup is chosen, and the drink is poured. This last step presents the largest chance for waste. Since the employee must portion the ingredients by hand, any overspill of the drink is left in the blender pot. At each step during this manual process, portion control is compromised, and money is potentially wasted on excess ingredients.

Once the order is complete and the customer has his or her drink, there is one last step to finalize the process—the method of manually cleaning the flavor/ingredient dispensing system, to prevent the transfer of flavors and germs. Depending on where the dispensing system is located within or in relation to the beverage machine, the dispensing system may be very difficult and inconvenient to clean, which adds significantly to the time and labor required for maintenance. Also, flavor contamination can be a serious threat if customers have food allergies.

Each step in this process to create a smoothie takes time, typically four to five minutes, and that time could be better spent serving customers or taking more food and beverage orders, directly contributing to the bottom line.

Although premium beverages such as smoothies are growing in popularity, most quick-service restaurants (QSRs) are unable to offer customers these options due to the time limitations of the quick-serve world. Those QSR owners that do opt to serve smoothies are confronted with a common set of challenges—mainly how to sell the same franchised drink time after time with existing labor and equipment limitations.

Accordingly, it has been determined by the present disclosure, there is a need for an assembly that dispenses and mixes beverage flavors/ingredients with ice in one integrated system, and thereafter can be cleaned in place, for immediate reuse without subsequent flavor contamination.

An additional problem regarding beverage dispensing systems is that they tend to result in dripping and formation of errant streams once the ingredient dispensing pumps cease dispensing the measured quantity of ingredients in to the vessel or cup. Conventional beverage dispensing systems typically result in maintenance and clean-up problems after each use. That is conventional syrup or ingredient pumps 3001, as shown in FIG. 26, result in the emission of errant streams or drippings post-dispensing to LMS valve 3003. That is, pump 3001 tends to discharge additional ingredients once the desired amount of ingredients have been dispensed into the vessel or cup, not shown. This additional ingredient discharge is a result of excess ingredients remaining in pump 3001 once the solenoid assembly 3005 is no longer energized, wherein the excess ingredients are discharged via residual pressure from pump 3001 to LMS valve 3003 resulting in either excess ingredients being dispensed into a beverage vessel altering taste of the resultant beverage or excess ingredients being discharged on to the beverage platform if the vessel has been removed therefrom resulting in a cleaning problem for the operator. In addition, compressible fluids are pressurized during pumping and when the pressure is removed the fluid will continue to discharge from the LMS valve 3003 until pressure in the system is equalized. This equalization causes fluid to drip or spray in a diminishing pattern while the pressure reduces to normal. In particular, currently there is not an existing reliable method for stopping a fluid system from dripping from a valve, for example, LMS valve 3003, given a compressible flow or a fluid containing contaminants or solid particles.

The present disclosure overcomes the issues related to discharge of excess ingredients by incorporation of a novel expansion valve between the syrup or ingredient pump and the LMS valve.

SUMMARY OF THE DISCLOSURE

An integrated beverage blending system comprising: an ice portion control module; an ingredient module; an ice dispensing conduit in communication with the ice portion control module; and an ingredient dispensing valve removably connected to the ice dispensing conduit and in communication with the ingredient module, wherein the ice is dispensed into a beverage container via the ice dispensing conduit and the ingredient is dispensed into the beverage container via the ingredient dispensing valve, wherein the ingredient module comprises a housing, an ingredient container disposed within the housing, a first ingredient conduit disposed between the ingredient container and the ingredient dispensing valve, and a pumping device that causes the ingredient to move from the ingredient container, through the first ingredient conduit, and through the ingredient dispensing valve under pressure, an expansion valve which receives the ingredient from the pumping device and passes the ingredient to the dispensing valve, wherein the expansion valve includes a second ingredient conduit and a diaphragm, wherein the diaphragm controls the diameter size of the second ingredient conduit in the expansion valve, such that the second ingredient conduit is reduced during dispensing of the ingredient to the dispensing valve and enlarged when the dispensing of the ingredient to the dispensing valve is terminated, and wherein each ingredient conduit is isolated from other ingredient conduits and the ice dispensing conduit, whereby product and/or flavor contamination is avoided.

The diaphragm in the expansion valve is controlled by the passing of pressurized $CO_2$ and/or air to a surface of the diaphragm opposite to the second ingredient conduit.

The above-described and other advantages and features of the present disclosure will be appreciated and understood by those skilled in the art from the following detailed description, drawings, and appended claims.

BRIEF DESCRIPTION OF THE DRAWINGS

FIG. 23 is a listing of controller steps for selecting ingredients/flavors, additives and serving cup size according to the present disclosure;

FIG. 24 is a listing of controller steps for dispensing ingredients into a pre-selected serving cup size, selecting which blending/mixer module is to be activated and activating the selected blender according to the present disclosure;

FIGS. 25*a* and 25*b* are a listing of controller steps and displays for a system setup mode according to the present disclosure;

DETAILED DESCRIPTION OF THE INVENTION

Figure 1:
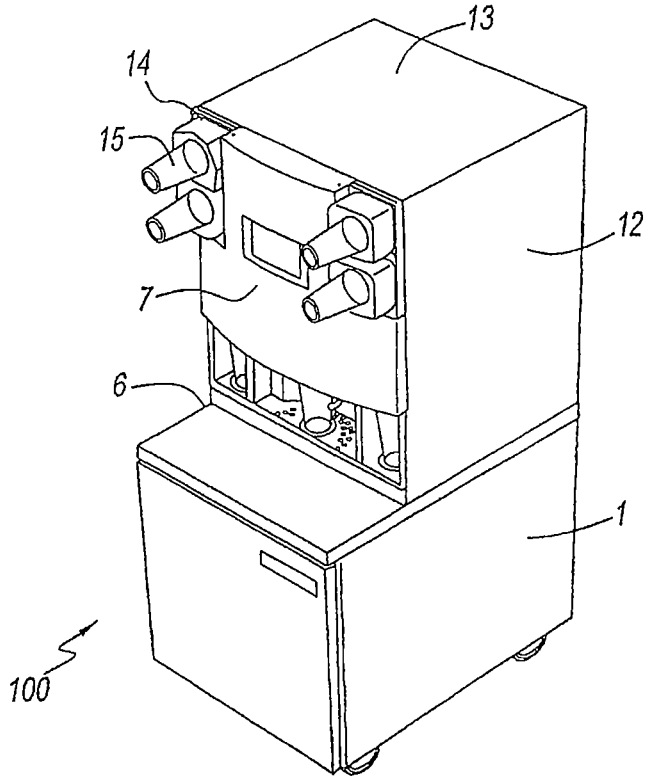
FIG. 1 is a front perspective view of an exemplary embodiment of an assembly that dispenses and mixes beverages according to the present disclosure.
Figure 4:
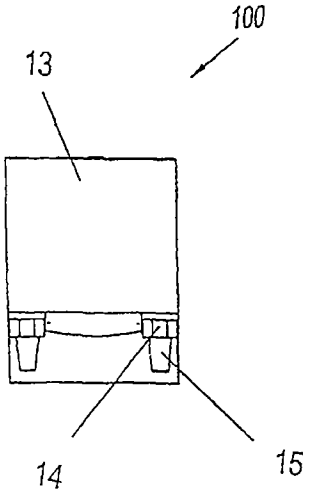
FIG. 4 is a top view of the assembly that dispenses and mixes beverages of FIG. 1.
Figure 3:
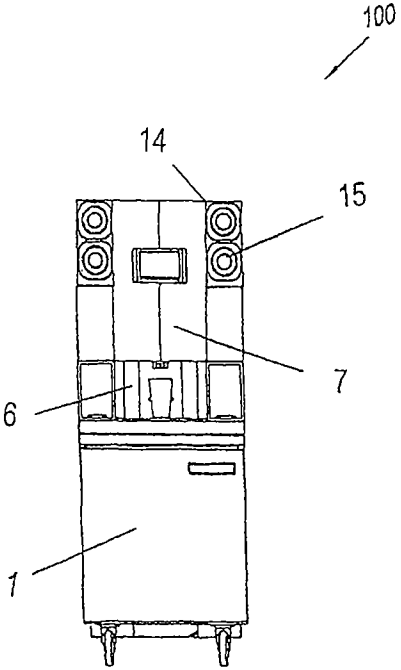
FIG. 3 is a front view of the assembly that dispenses and mixes beverages of FIG. 1.
Figure 2:
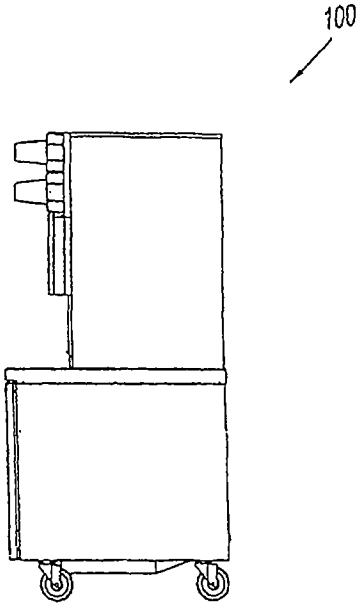
FIG. 2 is a side view of the assembly that dispenses and mixes beverages of FIG. 1.
Figure 5:
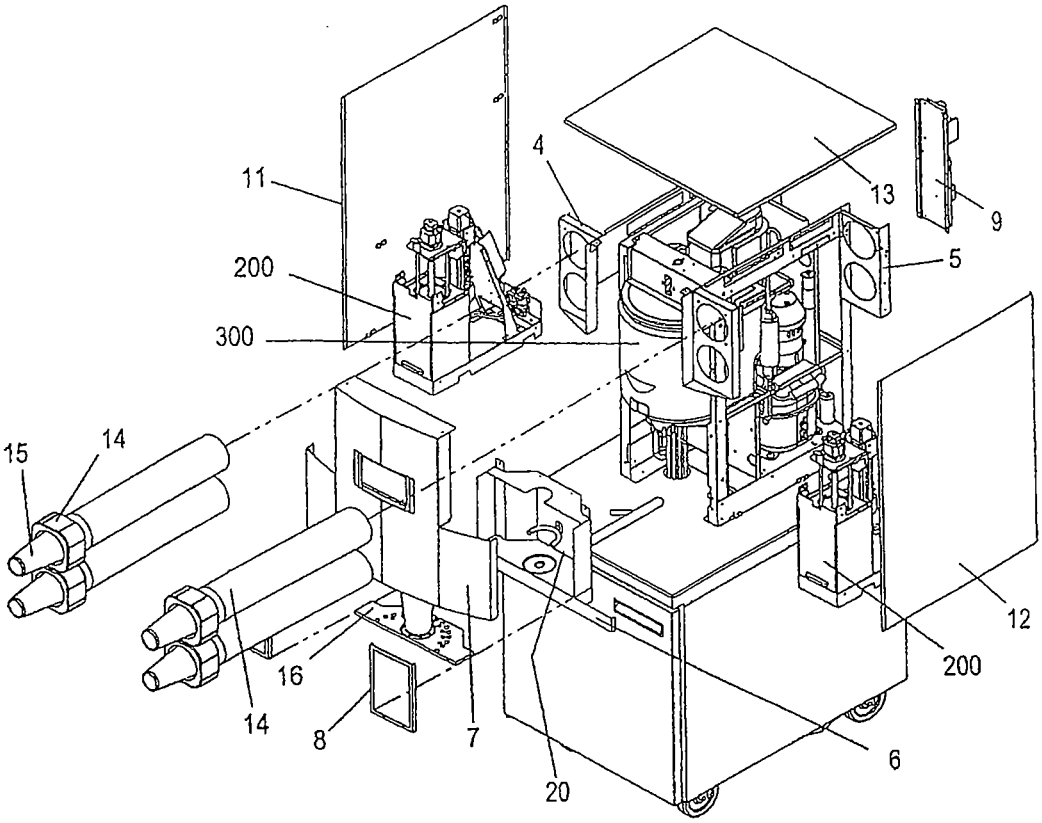
FIG. 5 is an exploded view of the assembly that dispenses and mixes beverages of FIG. 1.

Referring to the drawings and in particular to FIGS. 1-5, an exemplary embodiment of an assembly that dispenses and mixes beverages ("assembly"), according to the present disclosure is generally referred to by reference numeral 100. Assembly 100 makes ice, dispenses flavors/ingredients and ice into a serving cup 15, and then blends or mixes to form a beverage. One such beverage, for example, is a smoothie that preferably includes a flavor ingredient and ice mixed together. Assembly 100 has an onboard ice maker, ice storage and portion control module 300, a flavor/ingredient dispensing module 1100, and a blender/mixer/cleaning module 303. Assembly 100 shows ice maker, ice storage and portion control module 300, flavor/ingredient dispensing module 1100, and blender/mixer/cleaning module 303 as one integrated assembly. It is contemplated by the present disclosure that one or more of ice maker, ice storage and portion control module 300, flavor/ingredient dispensing module 1100, and blender/mixer/cleaning module 303 may be separate from assembly 100, however, it is preferable that they are all integrated into a single assembly 100. That is, vertical placement of ice maker, ice storage and portion control module 300, flavor/ingredient dispensing module 1100, and blender/mixer/cleaning module 303 reduces a size of assembly 100 and its associated flooring footprint in comparison to three separate and distinct machines.

Assembly 100 has a housing that includes a lower wall 6, an upper wall 7, side walls 11 and 12, and a top wall 13. Lower wall 6 has a container holder portion 20. The housing connects cup supports 4 and 5 that secure cup holders 14 to assembly 100. Cup holders 14 removably hold cups 15 therein. Cup 15 may be disposable or reusable single serving cups. If cup 15 is disposable, such as, for example, paper or plastic cups, the beverage dispensed and mixed within cup 15 may be served directly to a customer eliminating the step of pouring the beverage into a serving cup and eliminating labor needed to wash an additional container. Cup 15 may be any size, such as, for example, about 10 ounces to about 32 ounces.

Figure 6:
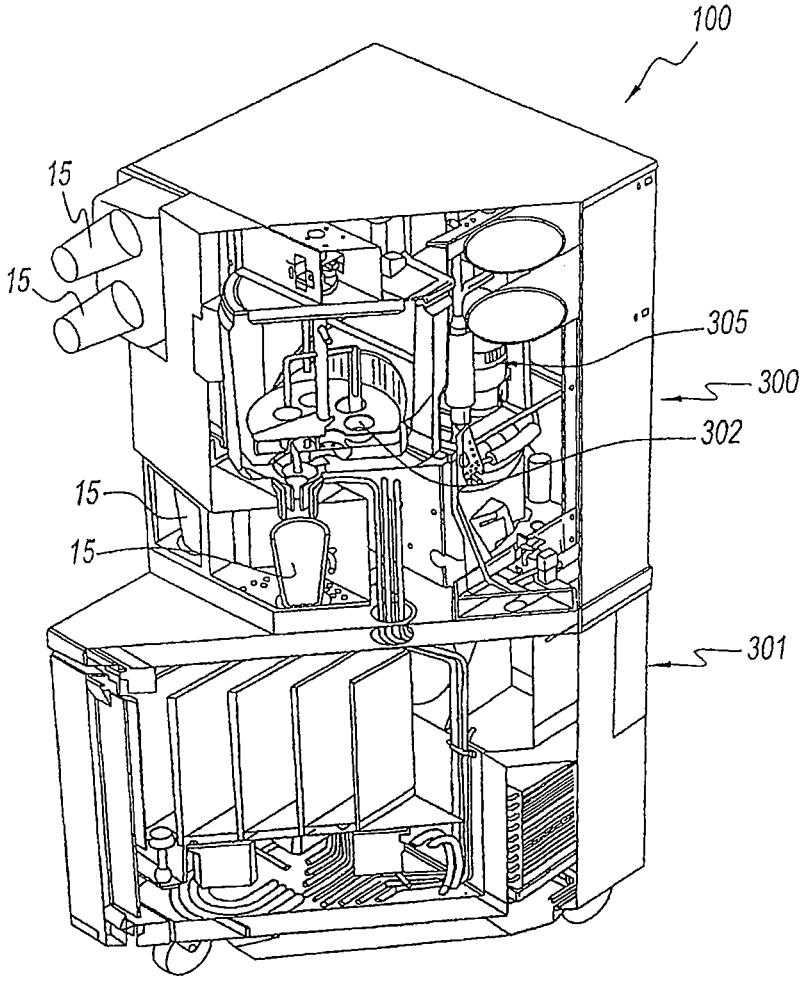
FIG. 6 is a top front left-side perspective view of the system of the present disclosure wherein the front left-side portion has been cut away to depict each of the ice making and portioning module, and dispensing module.
Figure 7:
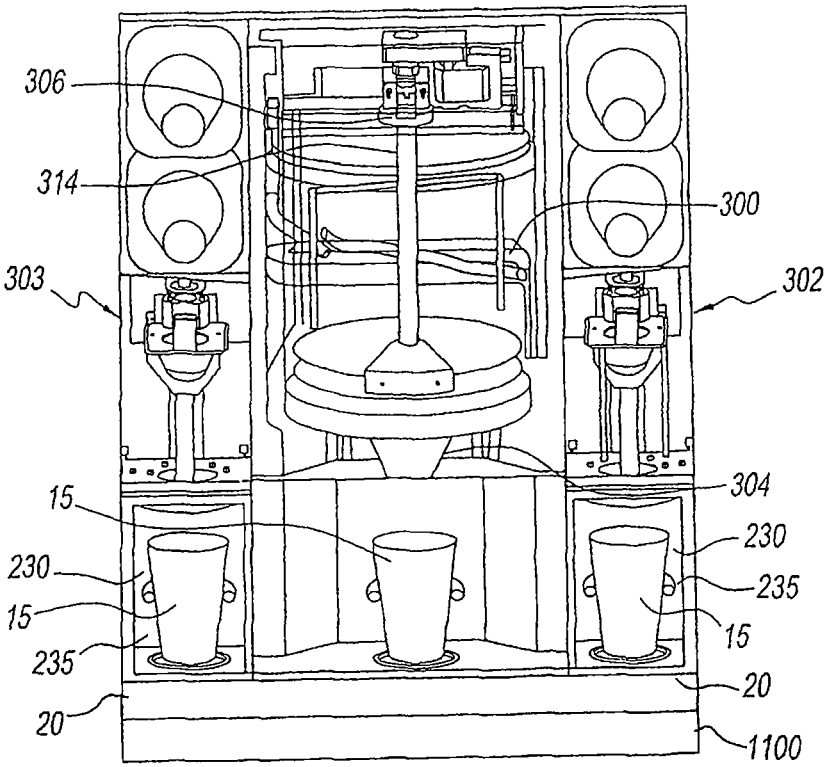
FIG. 7 is a partial front cross-sectional view of the integrated ice maker bin and portion control assembly, dispensing nozzle and pair of oppositely disposed mixer/cleaning modules according to the present disclosure.

FIGS. 6 and 7 provide an overview of the integrated assembly 100 according to the present disclosure, wherein assembly 100 comprises: flavor/ingredient dispensing module 1100, ice maker, ice storage and portion control module 300 and a pair of blender/mixer/cleaning modules 303 disposed on opposite sides of dispensing nozzle 304. Further aspects of assembly 100 are discussed in greater detail in co-pending U.S. patent application Ser. No. 12/633,790, entitled "AN INTEGRATED METHOD AND SYSTEM FOR DISPENSING AND BLENDING/MIXING BEVERAGE INGREDIENTS," filed on Dec. 8, 2009, which is herein incorporated by reference.

Figure 12:
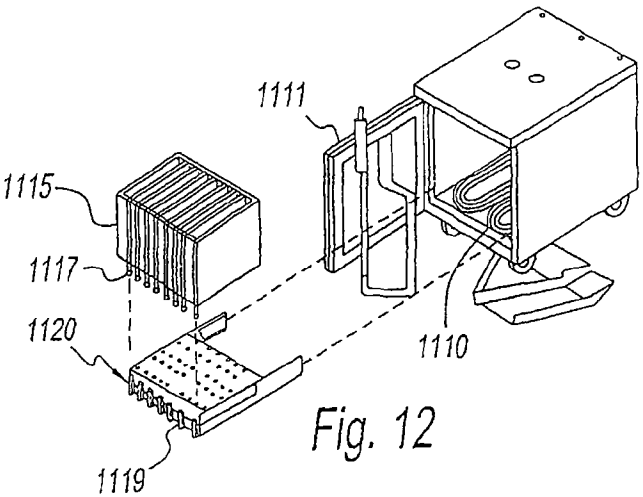
FIG. 12 is an exploded view of the ingredient dispensing module of FIG. 8.
Figure 8:
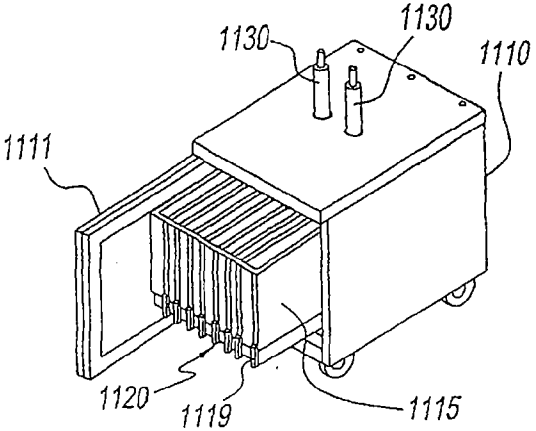
FIG. 8 is a front perspective view of an ingredient dispensing module according to the present disclosure.
Figure 9:
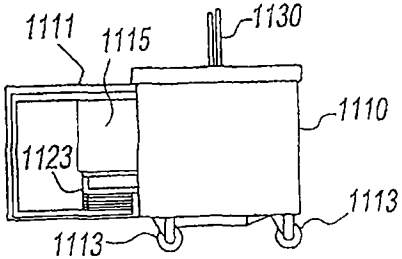
FIG. 9 is a side view of the ingredient dispensing module of FIG. 8.
Figure 11:
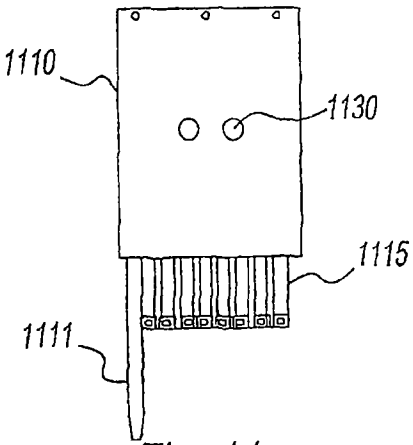
FIG. 11 is a top view of the ingredient dispensing module of FIG. 8.
Figure 10:
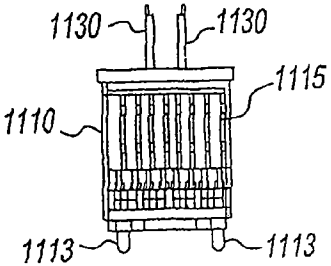
FIG. 10 is a front view of the ingredient dispensing module of FIG. 8.

Referring to FIGS. 8-17, flavor/ingredient dispensing module 1100 is shown. Referring to FIG. 12, flavor/ingredient dispensing module 1100 has an ingredient housing 1110. Ingredient housing 1110 can include a refrigeration cycle, such as, for example, a vapor compression cycle that includes a compressor, condenser, expansion valve, and evaporator. One or more of the compressor, condenser, expansion valve, and evaporator may be integral with flavor/ingredient dispensing module 1100 or remote from the rest of flavor/ingredient dispensing module 1100. For example, compressors may create undesirable noise and may be remotely located from the rest of assembly 100.

Ingredient housing 1110 can cool one or more holders or cassettes 1115. Holders 1115 each hold a flexible container (not shown) via a hanging rod 1116 (see FIG. 17). The flexible container can be, for example, a bag, that contains an ingredient for the beverage. Hanging rod 1116 can thread holes in the top of the flexible container, to support the container. The ingredient can be cooled while stored in holders 1115 by ingredient housing 1110, so that the ingredient is maintained at a food-safe temperature. Alternatively, ingredient housing 1110 can keep holders 1115, and the containers within them, at ambient temperature. The bag may be a 2.5 gallon bag. The ingredient may be a flavored liquid or mix. Each of the containers within holders 1115 can hold different ingredients, or alternatively, two or more of the containers can hold the same ingredient. Ingredient housing 1110 has a door 1111 and wheels 1113.

Figure 17:
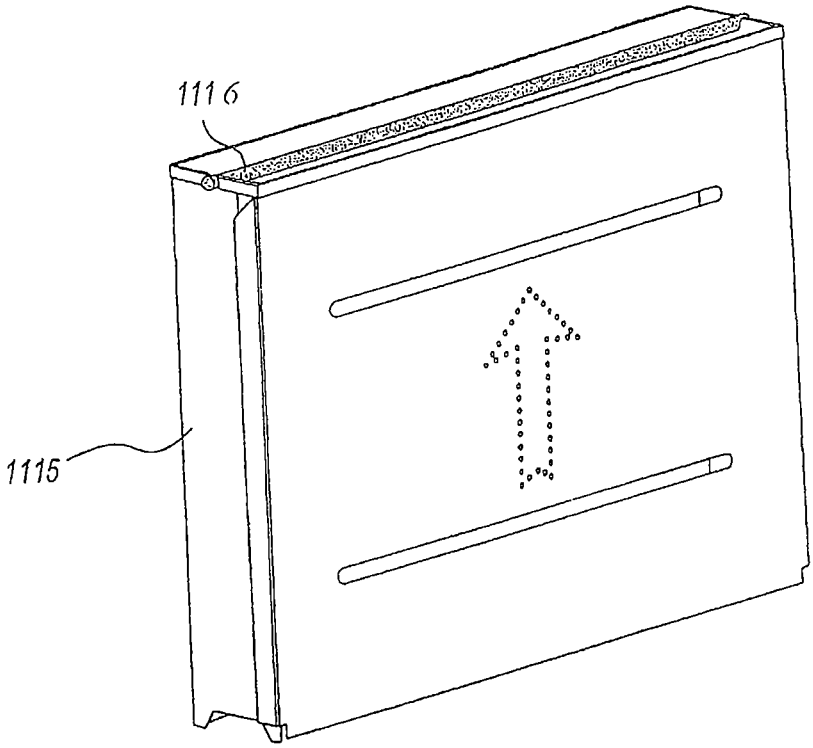
FIG. 17 is a top front right side perspective view of a ingredient dispensing cassette with a support bar according to the present disclosure.
Figure 17A:
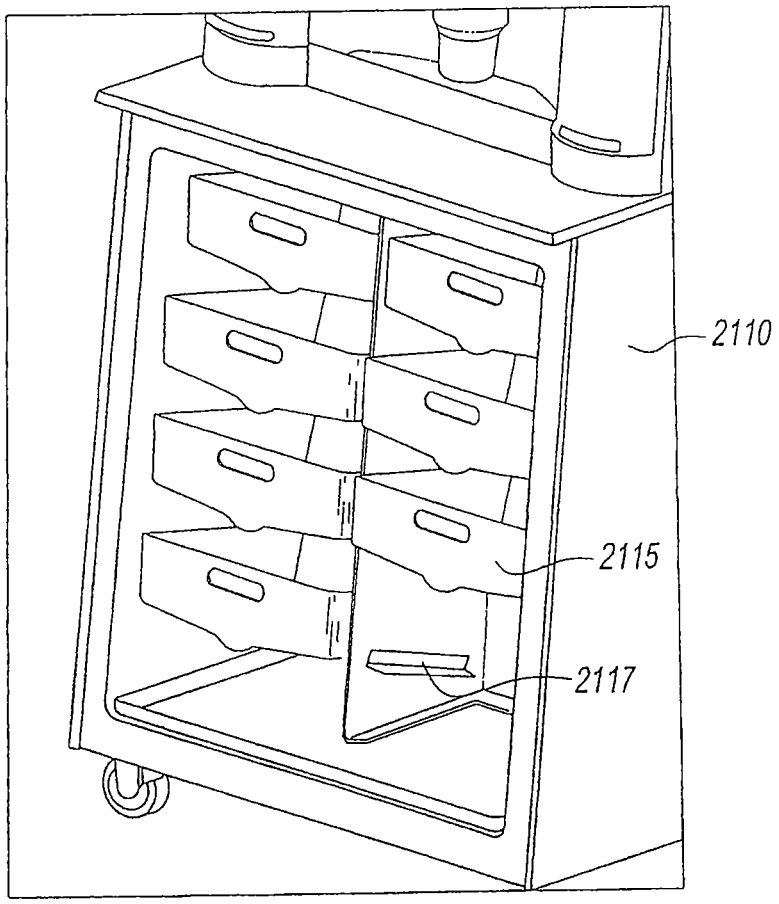
FIG. 17*a* is a front perspective view of a second embodiment of the ingredient housing of the present disclosure.

In the shown embodiment, flexible containers would be held in a vertical orientation, which helps to ensure a maximum extraction of ingredient from the flexible container. The present disclosure contemplates, however, a horizontal orientation for holder 1115, which is shown in FIG. 17*a* and discussed in greater detail below.

Each of holders 1115 has a connection tube 1117 connected thereto, so that the ingredient flows out of the flexible container, into one end of connection tube 1117, and out of the other. Connection tube 1117 can be integrally formed with the flexible container, or alternatively there can be a connector on the flexible container that allows for connection to connection tube 1117 and/or holder 1115. Connection tube 1117 has an aperture or gap 1118 (see FIG. 13*a*) at an end of connection tube 1117 that is connected to holder 1115 and the flexible container. Gap 1118 is a small opening or notch, for allowing substantially all of the flavor/ingredient disposed in the container to be removed without concern regarding the collapsing of the container (not shown). As the container is emptied of its contents, it collapses on itself, and may block the opening of connection tube 1117 that is connected to it. This would impede the further extraction of the flavor/ingredient from the flexible container. Gap 1118 allows more ingredient to be extracted, even in a situation where the container holding the ingredient is collapsed over the end of connection tube 1117.

Figure 13:
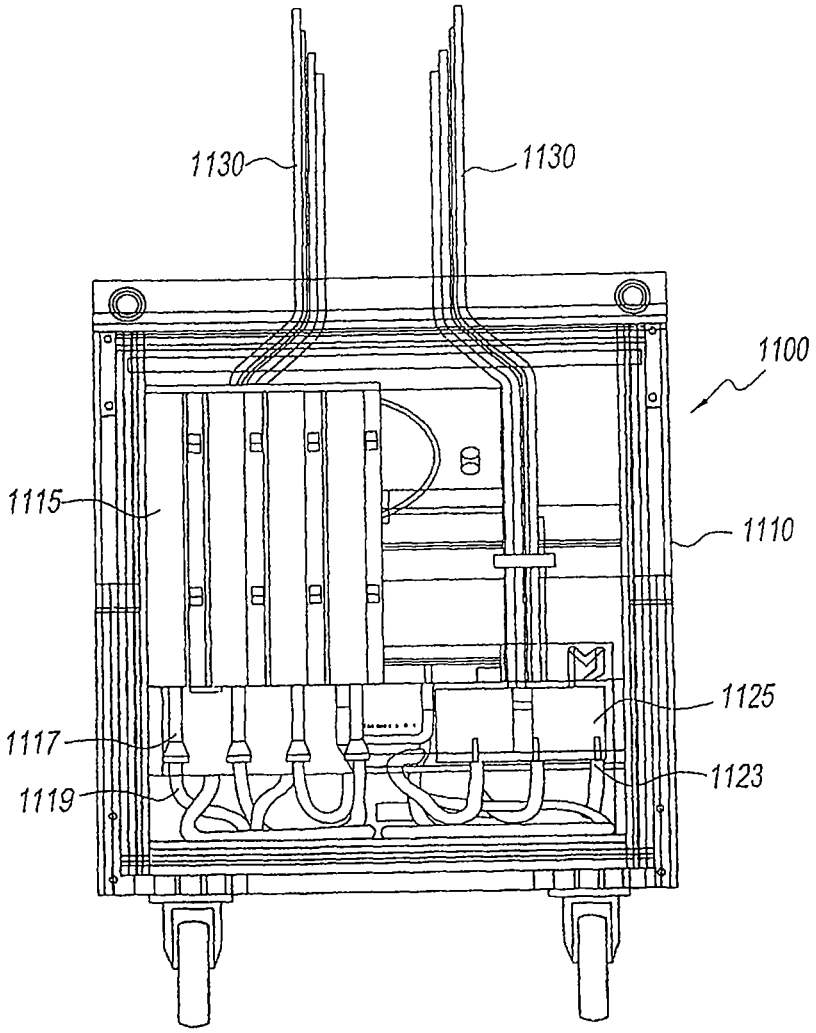
FIG. 13 is a front perspective view of an ingredient dispensing module according to the present disclosure.
Figure 13A:
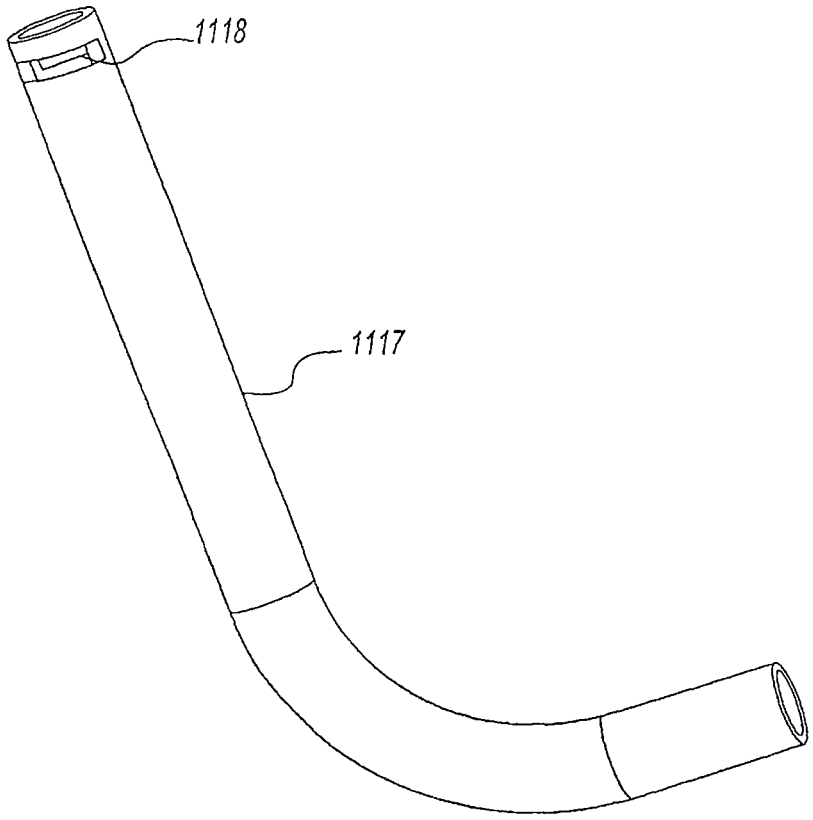
FIG. 13*a* is a connection apparatus for use with the ingredient dispensing module of FIG. 13.

Connection tube 1117 of each of holders 1115 is connected to a conduit 1119 that passes through a base 1120. As shown in FIG. 13, conduit 1119 may connect to a pump rack 1123. Pump rack 1123 has one or more pumps 1125 that selectively move a portion of the ingredient from the flexible container in holders 1115 through connection tube 1117, to conduit 1119, to expansion valve 3019, to a line conduit 1130, and to dispenser nozzle 304 to dispense the ingredient out of assembly 100, for example, to cup 15. The ice and the ingredient are dispensed into cup 15 but are segregated from each other until dispensed into cup 15 to prevent contamination. There is an ingredient dispenser tube for each ingredient in each of holders 1115 and one ice nozzle in nozzle 304.

Figure 14:
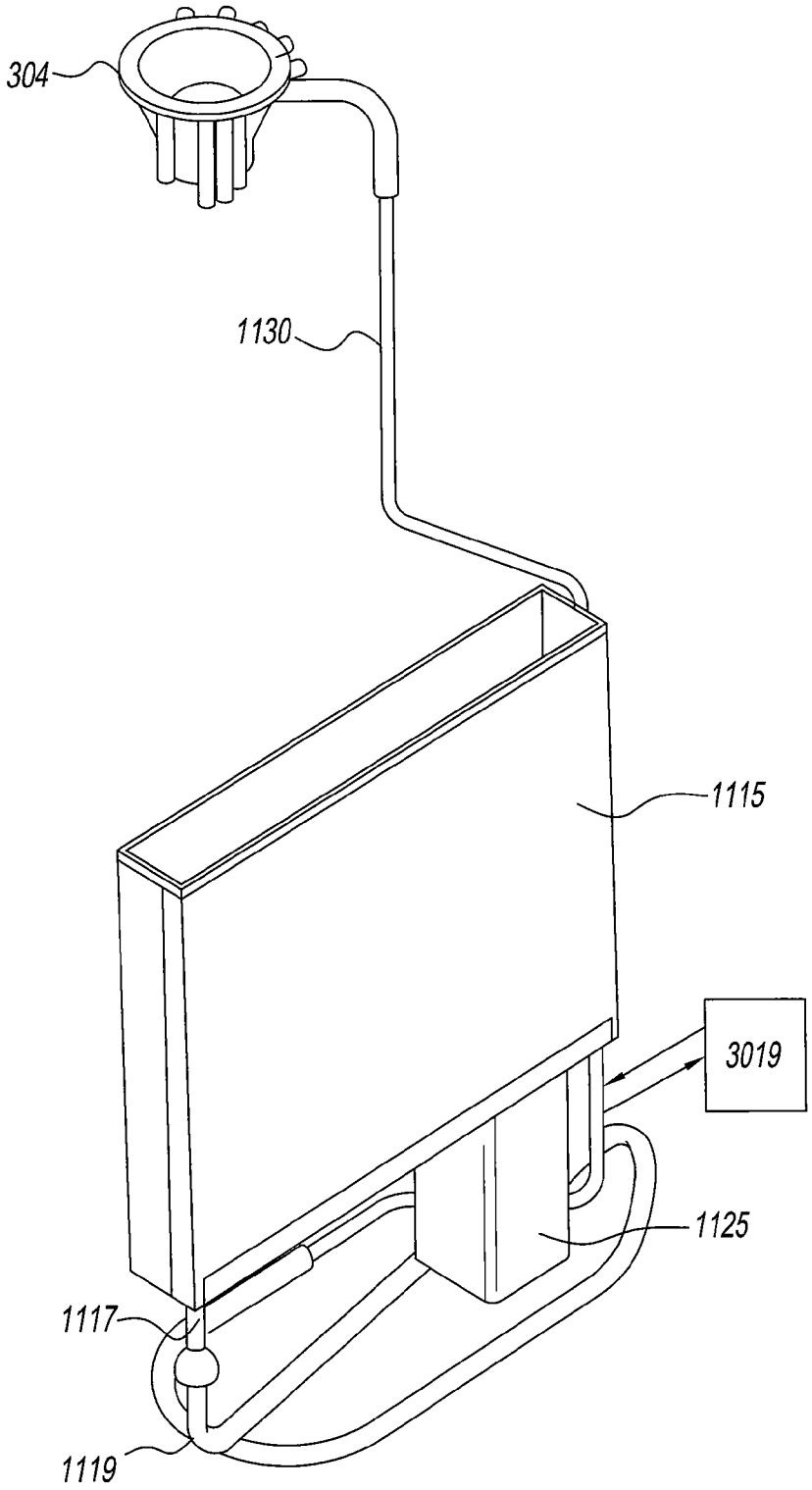
FIG. 14 is a front perspective view of a flavor/ingredient dispensing module according to the present disclosure.
Figure 15:
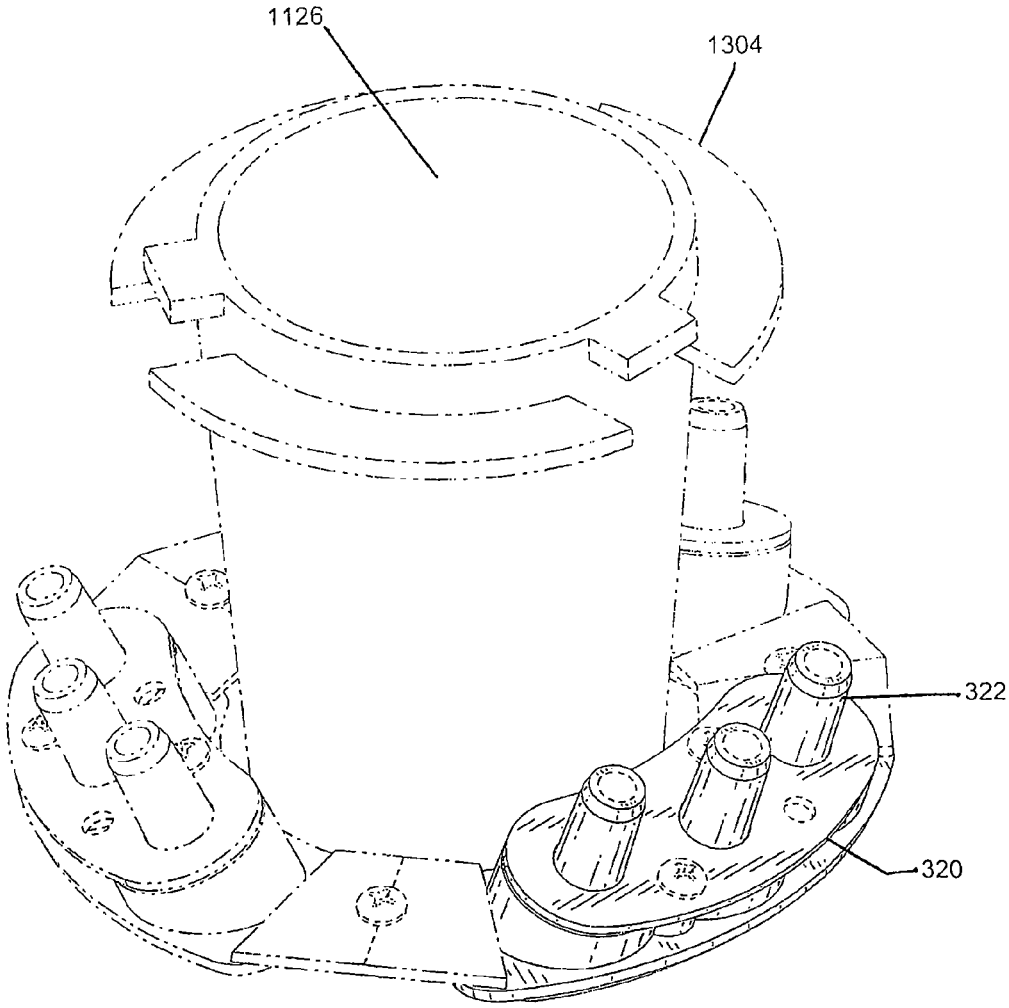
FIG. 15 is a perspective view of an ice chute and dispensing nozzle according to the present disclosure.

FIGS. 7 and 14 shows dispenser nozzle 304 as being injection molded from a plastic material, so that an ice-dispensing chute and one or more ingredient conduits are integrally formed into one component. In FIGS. 15-16*c*, dispenser nozzle 1304 is shown in detail. In this embodiment, nozzle 1304 has a central chute 1126 for dispensing ice into a cup 15, as described above. Nozzle 1304 can be used in place of nozzle 304. Nozzle 1304 has one or more ingredient valve blocks or assemblies 320 disposed around an exterior side of nozzle 1304, on an opposite side of nozzle 1304 from central chute 1126.

Valve assemblies 320 have one or more ingredient dispensing valves 322 connected thereto. Upper plate 328 and lower plate 329 are removably connected to each other, and can be used to secure valves 322. Assembly 320 can then be removably connected to dispenser nozzle 1304 as shown. In the embodiment shown in FIG. 15, there are three valve assemblies 320, each of which comprise three valves 322. However, the present disclosure contemplates different configurations, for example assemblies 320 that have one or more valves 322, or where one or more assemblies 320 are connected to dispenser nozzle 1304. The present disclosure also contemplates embodiments where different assemblies 320 have different numbers of valves 322. For example, a first assembly 320 can have one valve 322, a second assembly 320 can have two valves 322, and a third assembly 320 can have three valves 322.

As shown in FIG. 16*c*, valves 322 have an interior passage 323, a lower end 324 with a reversible dome 325 disposed therein, and upper end 327. Dome 325 has an upper surface 326 that is convex with respect to passage 323, i.e. that it extends in a direction toward upper end 327. Upper end 327 and passage 323 can be in fluid communication with conduit 1130, and thus ingredient holders 1115, as is discussed in greater detail below. Each valve 322 can be connected to a separate ingredient holder 1115.

Dome 325 has a slit or opening on upper surface 326. When the ingredient is being forced through passage 323 in the manner described above, dome 325 allows the ingredient to pass through the opening on upper surface 326. Dome 325 may partially or completely invert as the ingredient passes through the opening. When the ingredient is not flowing, e.g. when there is not significant pressure placed on upper surface 326 of dome 325, no ingredient passes through the opening thereon.

Valve 322 is highly advantageous in that it prevents ingredient from leaking outside of a refrigerated zone, and then being placed into a drink the next time the machine is used. Even after the flow of ingredient is shut off, there will be a residual flow of ingredient through the dispensing mechanism. In machines where valve 322 is not used, some of the ingredient can migrate outside of an area that is kept refrigerated. This can create an unsanitary situation, if the residual ingredient is mixed into a drink the next time the machine is used. Valve 322 prevents this from happening, since dome 325 is inverted, and prevents the residual flow from leaking out of passage 323. The only time when dome 325 will allow ingredient to pass through the opening therein is when there is a significant pressure placed dome 325, i.e. when ingredient is deliberately forced through.

In addition, assembly 320 can provide for more flexibility and ease of service than in other embodiments or devices. As shown in FIG. 15, assemblies 320 can be removably connected to dispenser nozzle 1304. This allows for easier servicing of dispenser nozzle 1304 and/or assemblies 320, and/or valves 322. It also allows for more flexibility in the number and configuration of assemblies 320 and valves 322.

Figure 16A:
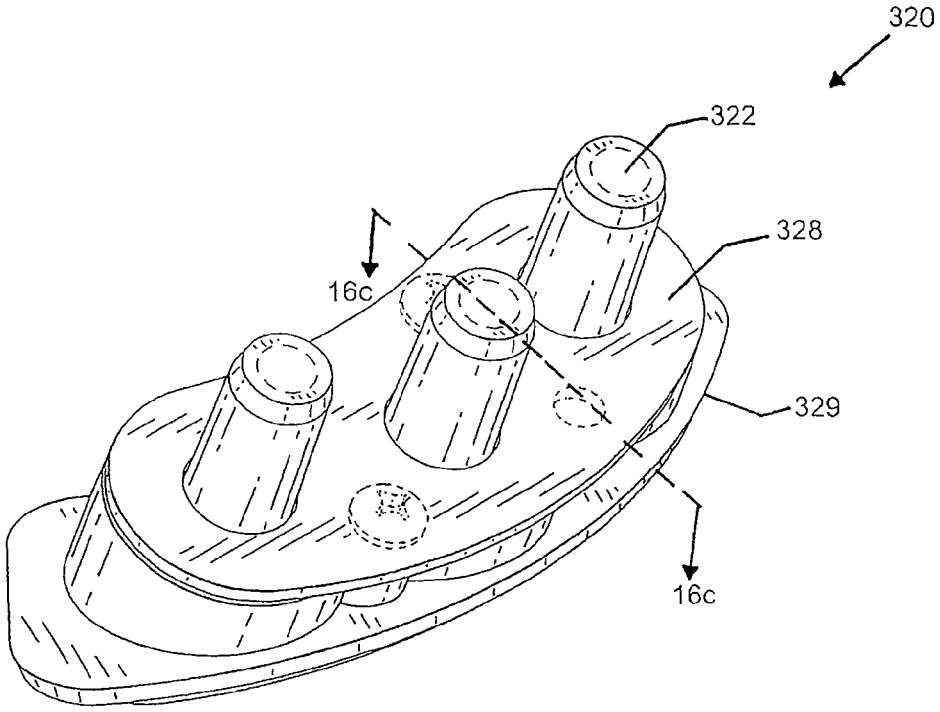
FIG. 16*a* is a first perspective view of a valve assembly of the present disclosure.
Figure 16B:
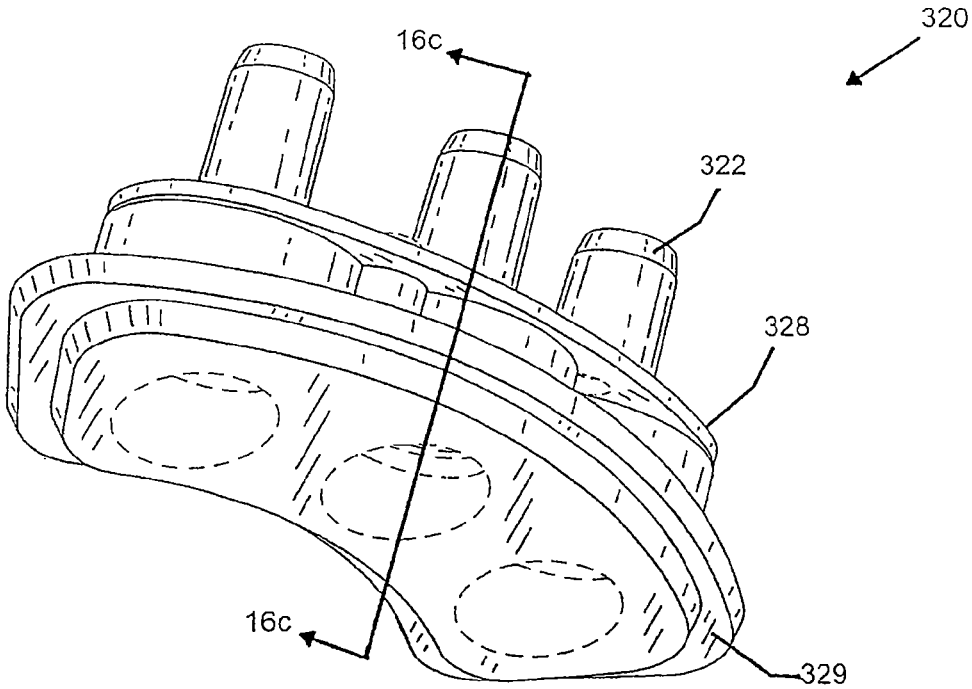
FIG. 16*b* is a second perspective view of the valve assembly of FIG. 16*a;*
Figure 16C:
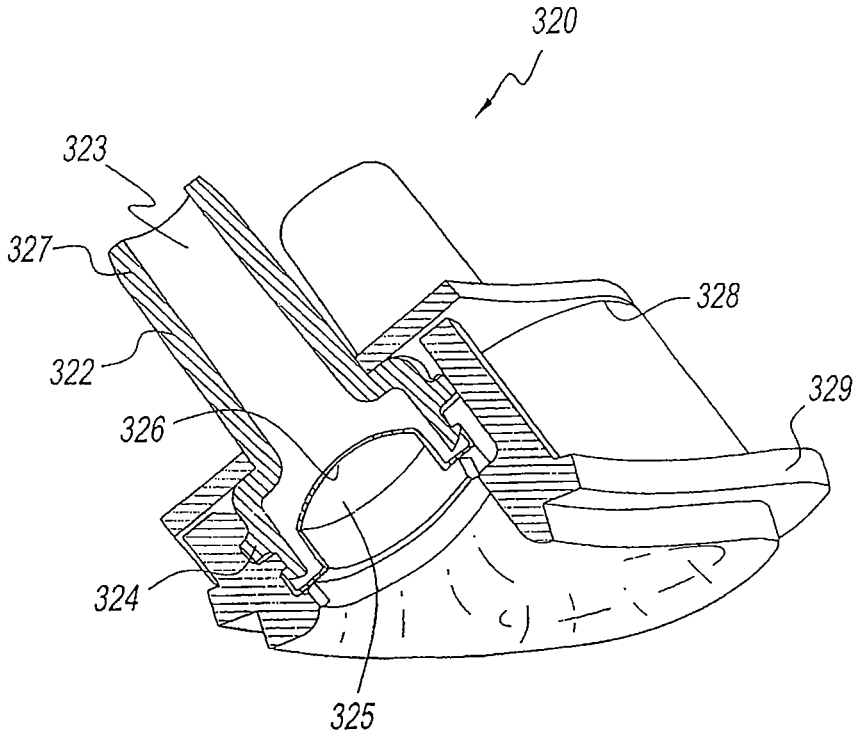
FIG. 16*c* is a cross-sectional view of the valve assembly of FIGS. 16*a* and 16*b*, taken along line 16*c*-16*c;*

As shown in FIGS. 16*a-c*, valves 322 can be angled with respect to a central axis of dispenser nozzle 1304. The angled position of valves 322 allows for an easier connection to conduit 1130, and again, allows for easier servicing of assemblies 320 and valves 322. If the angle is too severe, cup 15 can tip over when ingredient is dispensed.

As shown in FIG. 14, conduit 1119 may connect to a pump 1125. Pump 1125 selectively moves a portion of the ingredient from the container in holders 1115 through connection tube 1117, to conduit 1119, to a line conduit 1130, and to dispenser nozzles 304 or 1304 to dispense the ingredient out of assembly 100, for example, to cup 15. Pump 1125 may be an air powered pump that may include a diaphragm. Pump 1125 may also be a pressure pump, or a peristaltic pump. When pump 1125 is a pressure pump, it provides a constant pressure within holder 1115, that is applied to the flexible container. Holder 1115 would have to be sealed for this to be effective. A solenoid can regulate flow of the ingredient out of the flexible container. When the solenoid is opened, the ingredient will flow out of the flexible container at a known rate, given that the pressure applied to the flexible container and the impedances of the system are also known, as discussed below. This pressurized pumping system has been found to be particularly effective for ingredients that include "stringy" components, such as pulp.

A portion of the ingredient, such as, for example, a fruit base, may be controlled by time. A controller maintains accuracy by determining an amount of the fruit base that has been delivered from the flexible container in holder 1115. As a fluid level decreases within the container within holder 1115, the controller allocates a longer delivery time to compensate for a decrease in head pressure within the container within holder 1115. Pump 1125 may be positive displacement and a controller controls the pumps on a time basis. The time can be adjusted to control portion accuracy. Assembly 100 may only dispense ice from ice maker, ice storage and portion control module 300 into cup 15 and not an ingredient from flavor/ingredient dispensing module 1100.

Figure 18:
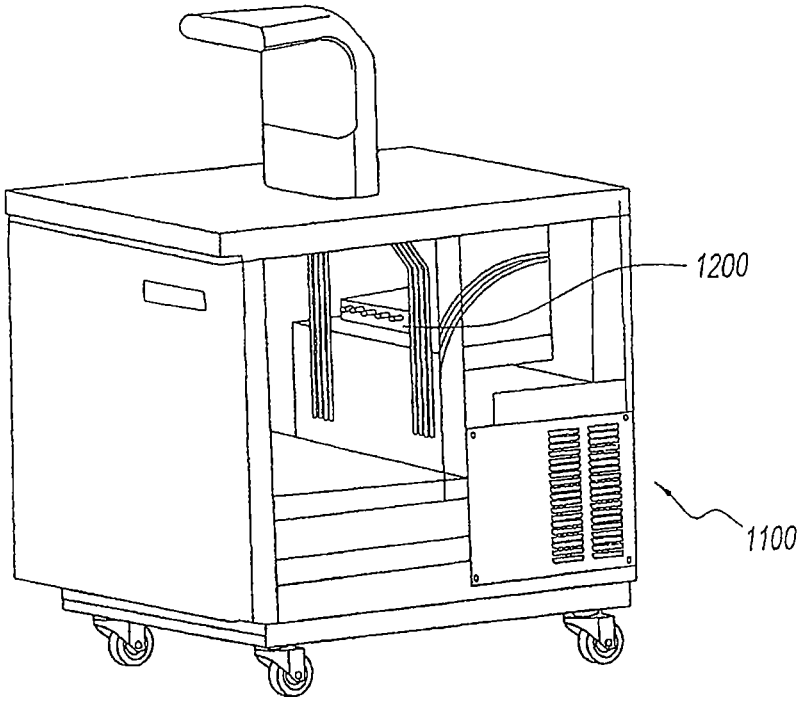
FIG. 18 is a transparent, perspective view of a flavor/ingredient dispensing module of the present disclosure.

A water reservoir (not shown) can be within ingredient housing 1110, or alternatively can be located remotely from ingredient housing 1110. In either embodiment, the water reservoir can be used to provide water to the beverages made by the machine. In addition, the water reservoir can be used to clean out dispensing module 301 in place. This feature has the benefit of significantly reducing the amount of labor required to keep dispensing module 301 clean, and avoid flavor contamination when different ingredients or flavorings are switched out of ingredient housing 1110. The water reservoir can be connected to any point on the line for dispensing the ingredient to dispenser nozzles 304 or 1304. For example, the water reservoir can be connected to any of connection tube 1117, conduit 1119, or line conduit 1130. A manifold 1200, as shown in FIG. 18, can be used to connect the water reservoir to these components, either manually or through the use of solenoid valves.

For cleaning, clean water can be run through the ingredient dispensing system. Alternatively, detergent can be placed in the water reservoir, and/or in manifold 1200. The detergent can be in liquid or pill form. The water and/or the detergent is circulated through the flavor/ingredient dispensing system as described above, and then drained from ingredient housing 1110. The water reservoir is then filled again, and purged, to ensure that there are no residual detergent chemicals left in the system. The reservoir is then refilled.

Figure 17B:
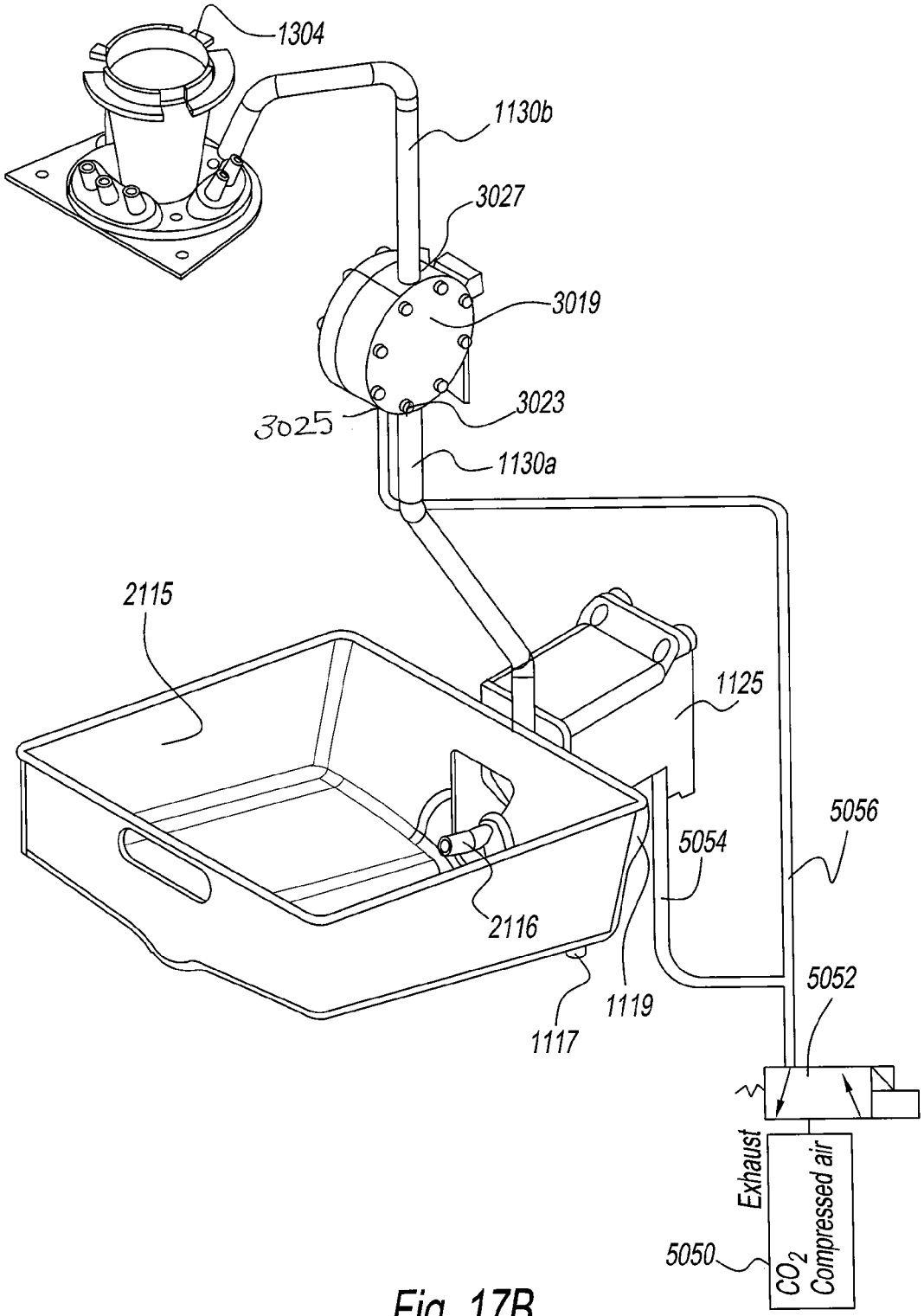
FIG. 17*b* is a front perspective view of a flavor/ingredient dispensing module according to the second embodiment of the ingredient housing of FIG. 17*a;*

As previously discussed, FIG. 17*a* shows another embodiment of an ingredient housing of the present disclosure, and is referred to by numeral 2110. Housing 2110 has ingredient holders 2115 therein, which are in a substantially horizontal (i.e. pitched) orientation, as opposed to the vertical orientation of holders 1115. As with holders 1115, a flexible container (not shown) can be disposed therein. In the horizontal orientation, each holder 2115 slides into ingredient housing 2110 using guides 2117. Guides 2117 are at a slight angle, and the ingredient within holders 2115 is thus pushed toward the rear of housing 2115 under the force of gravity. A connector 2116 (FIG. 17*b*) located at the back of holder 2115 can connect the flexible containers within holders 2115 to connection tube 1117, which is also at the back of ingredient housing 2110, so that the ingredient can be dispensed into cup 15 in the manner described above. In this embodiment, connection tube 1117 and conduit 1119 can be mounted and designed to mate with holders 2115 so that tube 1117 and conduit 1119 give as holder 2115 is placed in housing 2110, to facilitate the connection of tube 1117 to holder 2115.

Figure 19:
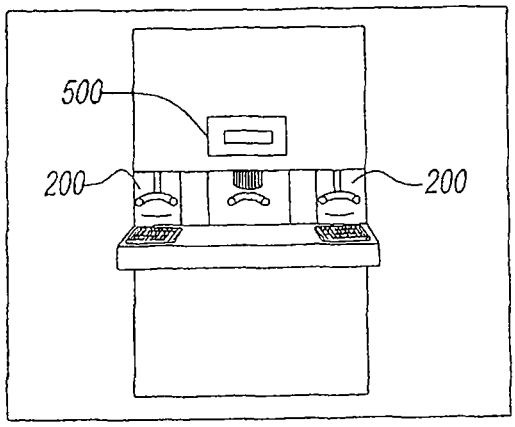
FIG. 19 is a front planar view of an exemplary embodiment of the system according to the present disclosure.
Figure 20:
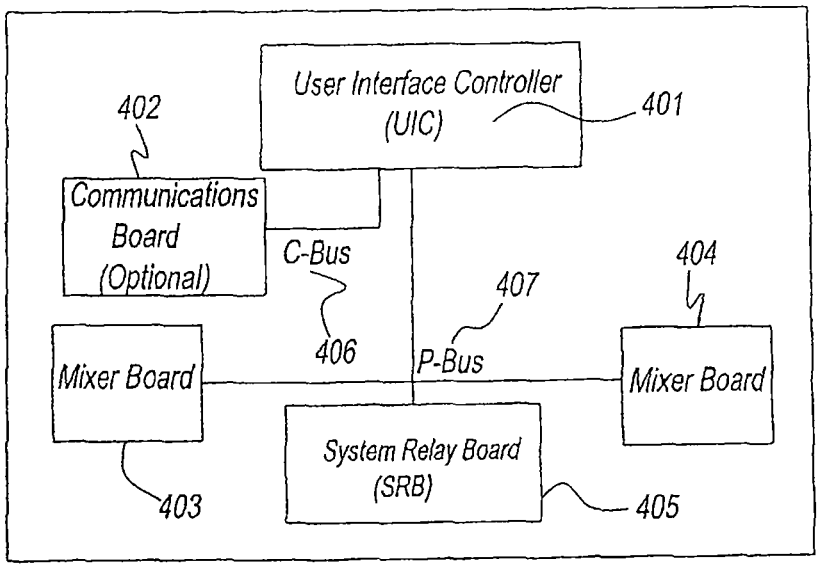
FIG. 20 is a block diagram of an exemplary embodiment of a system according to the present disclosure.
Figure 21:
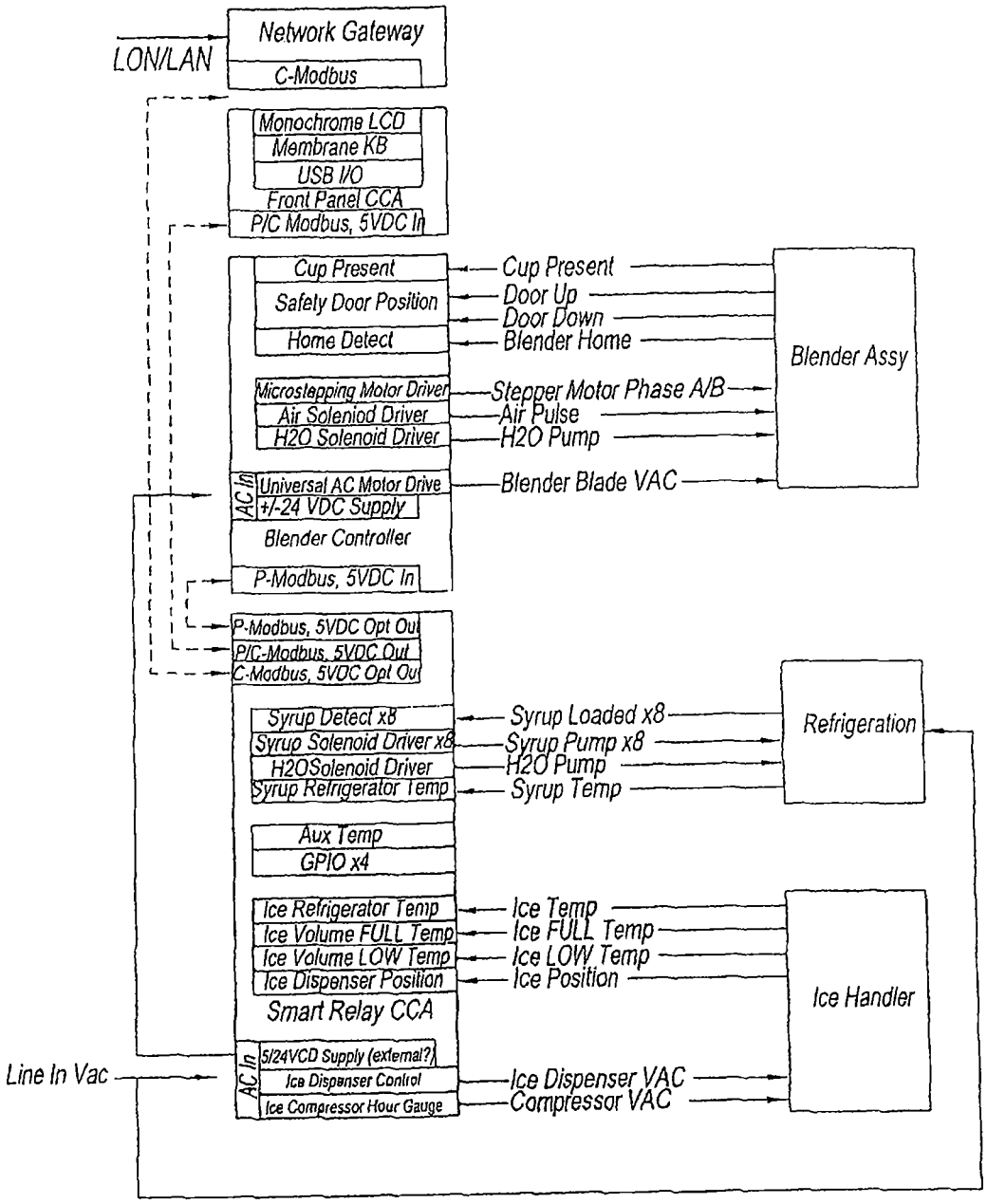
FIG. 21 is a block diagram of the network gateway, front panel display controller, blender/mixer and cleaner module controller and ice making and portion controller according to the present disclosure.
Figure 22:
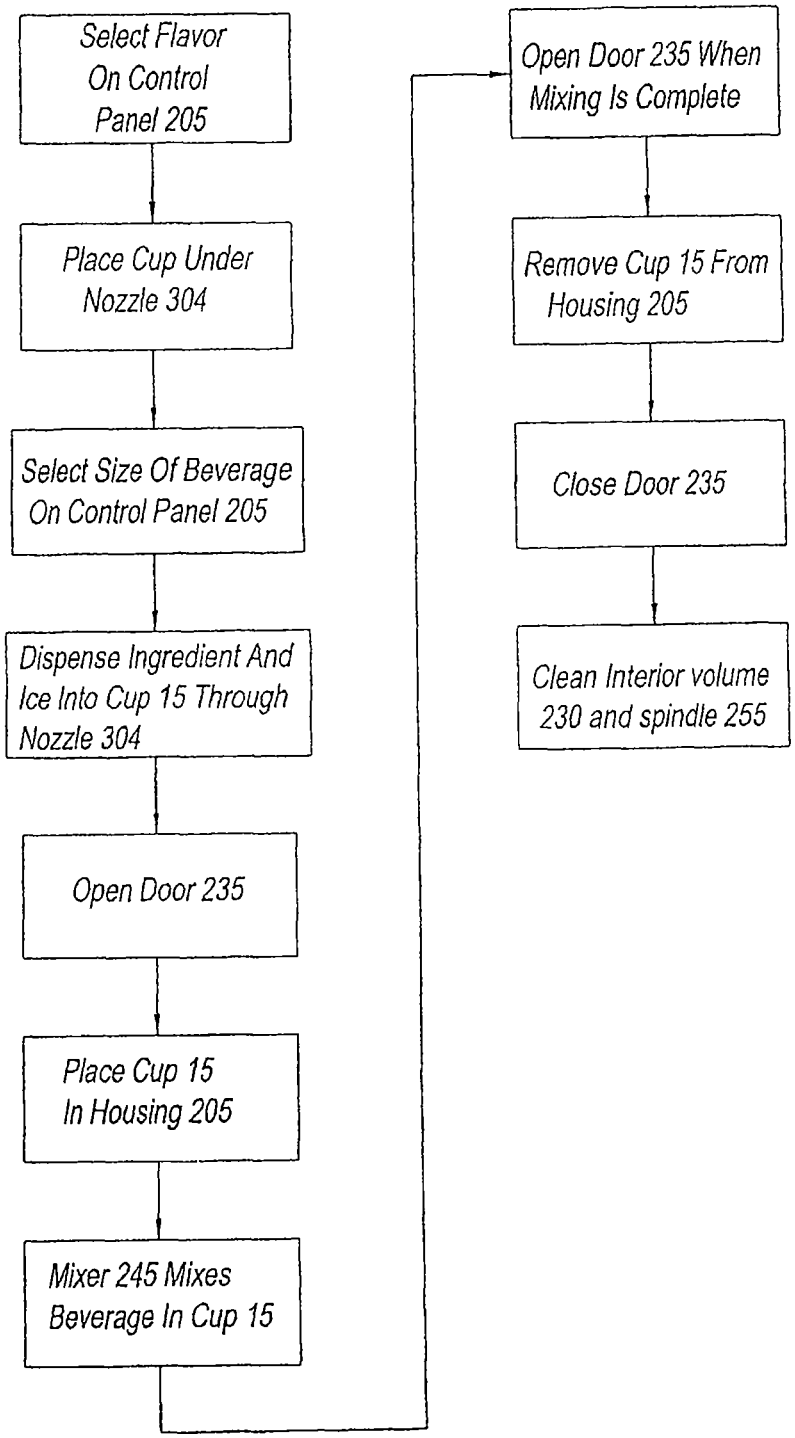
FIG. 22 is a process flow diagram of an exemplary embodiment of a method for dispensing, blending/mixing and cleaning according to the present disclosure.
Figure 26:
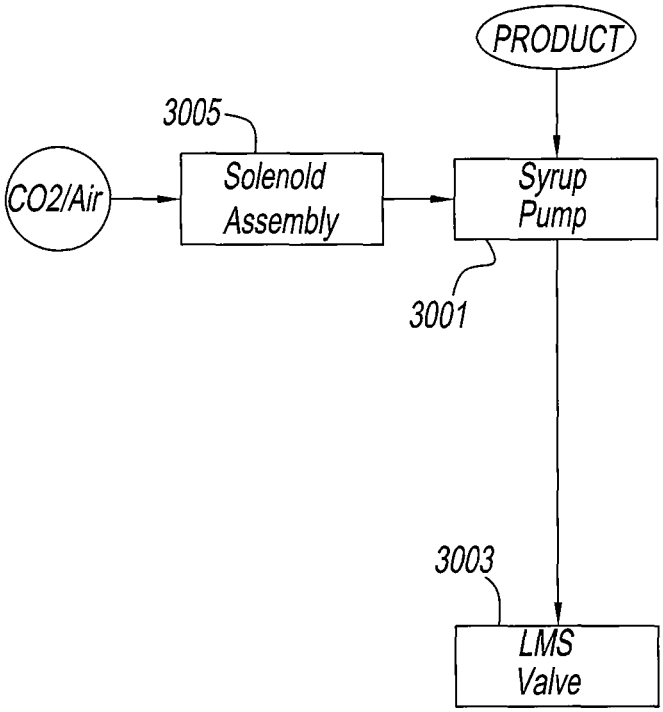
Fig. 26 (Prior Art)
FIG. 26 is a block diagram of a conventional ingredient pumping system used with the ingredient dispensing module.

FIG. 20 shows a structure of control boards identifying that they are separate but interconnected. This provides flexibility in the design allowing additional boards to be added without re-designing the entire controller. FIG. 21 shows a user interface controller 401 that incorporates a button panel, such as a control panel 500 shown in FIG. 19, that an operator uses to select the drink as well as a computer that interconnects to other control boards. A communications board control board 402 provides a gateway for communication to various methods (web, modem, USB, and the like.). Mixer boards 403 and 404 are mixer control boards that contain logic controllers for the operation of mixer blender blade 255 and linear slides 240. Smart relay board 405 is a control board that houses switching relays for ice maker, ice storage and portion control module 300, flavor/ingredient dispensing module 1100, mixer spindle motor 240, linear slides 241, water solenoid 280, and air solenoid 220*a*. C-bus 406 is a communication interconnect. P-bus 407 is a wiring interconnect between boards.

FIG. 21 is block diagram showing inputs and outputs of assembly 100. Network Gate C modbus Communication module that allows communication via modem, internet, and the like. Front Panel CCA User interface that includes Monochrome LCD, Membrane KB and USB i/o. Blender controller receives sensor input from blender/mixer/cleaning module 303 that determines the presence of cup 15, the home location of the spindle, and contains control logic for initiating mixer motor and linear drive motor, water and air solenoid signals. Blender controller has a controller for handling control of refrigeration system including syrup solenoid driver, water solenoid driver, syrup bag presence detection, and syrup temperature. Blender controller has additional capabilities of monitoring temperature of ice, level of ice in bin, low temperature alarm, and dispenser position.

Definitions, acronyms, and abbreviations may include:

| Abbreviation | Definition |
|---|---|
| UIC | User Interface Controller |
| SRB | System Relay Board |
| P-BUS | Peripheral bus |
| C-Bus | Communication Bus |
| CCA | Circuit Card Assembly |
| SFR | System Functional Requirements |

Referring to FIGS. 19 and 20, assembly 100 may be a "Smoothie maker system" that consists of an integrated ingredient dispensing unit, up to 4 mixing units (expandable from 2 in normal configuration), and a control panel for user operation.

As depicted in FIG. 21, the system is designed using a Smart Relay CCA, two mixer CCAs (normal configuration), an optional communications board for external communications, and a user interface controller board. All of the subsystem boards communicate with each other using a MODBUS protocol and RS-485 physical link.

Smart Relay CCA is responsible for dispensing control, monitoring and safety of the system ice-maker, and flavoring assembly/subsystem. Also the Smart Relay CCA provides the power and Modbus hub for the Smoothie System control electronics.

The Blender Controller CCA is responsible for position, speed, cleaning and safety control of the system blender assembly/subsystem, such as blender/mixer/cleaning module 303. It controls the blender blade, water and air pumps and senses cup present and door switch.

The user interface controller board consists of a monochrome LCD display, membrane keypad for control and configuration.

Referring now to FIGS. 19-25*b*, functional requirements of an exemplary embodiment of the present disclosure are shown and described.

The system shall have method for configuration for the following:

1. Mixing profiles
2. Particular fluids selections (x out of 254 displayed)

The system shall automatically go into a configuration download menu if in idle when a SD card is inserted.

The User Interface shall have a degrees F/C selection for temperature display in the setup mode.

Dispenser Flavor(s)

The maximum Number of Flavors per Serving shall be 3.

The minimum Number of Flavors per Serving shall be 1, unless dispensing ice only.

A flavor selection status shall be toggled by pressing the button corresponding to the flavor in question.

Upon reaching the maximum Number of Flavors per Serving, the system shall not allow selection of any additional flavors; unselected flavors become locked-out.

The user shall be able to change the flavor selection(s) by pressing the CANCEL button and selecting desired flavor(s).

The user shall be able to change the flavor selection(s) by first de-selecting a (the) flavor(s), then selecting the desired flavor(s).

Unit shall monitor use cycles of flavors and provide a user indication on the display of low level for each flavor for early warning of flavor out.

Dispenser Additive(s)

The additives consist of a selection of 2 types of fresh fruit and yogurt. Only the yogurt is dispensed automatically; instead of dispensed, the fresh fruit has to be manually added. The fresh-fruit selections are used to compute the amounts that are dispensed. Fruit is placed in cup prior to receiving the ice and fruit.

The Maximum Number Of Selectable Additives shall be 3.

The Minimum Number Of Selected Additives shall be 0.

Refrigerated Base (Flavor Storage)

The Fruit flavors and yogurt shall be stored in a refrigerated base designed to maintain a product temperature between 34° F.-38° F.

Base will be designed to accommodate up to 8 flavors (6 flavors is default for general market).

The base design will be such that flavors can be stored in Mylar "bag-in-box" packaging.

The base will house flavor pumps (up to 8) and all associated delivery tubing, and air solenoid switches.

The base will be designed to intake and discharge condenser air from the front of the unit.

The base dimensions will be: 26" w×33" d×32" h.

The base will be mounted on castors to allow access to rear of unit for cleaning.

The base will be designed to meet NSF and UL requirements.

The base will have openings in top to allow tubing to pass into dispense area.

The base will provide a method air delivery and return to dispenser section to maintain product temperature to the dispense nozzle (per NSF).

The base refrigeration system will require 120 v AC with the option for 220 v/50 hz (Europe requirement).

Ice Making

Smoothie machine will have on-board ice making capabilities

The device shall have ice machine capability to store 9 kg of ice in addition to ice making capabilities.

The ice machine shall generate hard nugget ice.

The ice machine will have the capability to generate a minimum of 240 lbs of ice per day.

The ice machine will be designed to operate on 120V 60 hz +/−10%.

The ice machine shall have provisions for 220 50 Hz operation for Europe +/−10%.

Ice Dispensing

Ice is normally dispensed during the smoothie making process but could also be dispensed exclusively.

The system shall allow dispensing of ice in an exclusive manner (i.e. without flavors or water).

Ice shall be dispensed in a portion amount that allows scaling for various drink cup sizes.

Ice amount shall be dispensed with an accuracy of ±10%.

The system shall provide a button for ice only dispensing.

Upon selection of the ice-only button, the system shall proceed to cup size selection.

The ice-only button shall only be available when no flavors are selected. Conversely, upon selection of a flavor the ice-only button shall be disabled.

There shall be a Service maintenance mode to allow cleaning on the dispenser fluid lines.

Cup Size Selection

The system shall allow cup size selections of small, medium large, and extra large, with a provision for additional cup sizes determined by customer.

Provisions will be made for cup storage on the unit.

Cup size selection shall trigger the dispensing process.

There shall be up to five configurable cup sizes with configurable volumes.

Cup shall be placed under dispense nozzle prior to drink selection (no UI to tell you).

Dispensing

The dispensing process shall use the cup size as a scaling factor to compute ingredient amounts; water, ice and selected flavors/additives.

The ingredients and quantities dispensed shall be used to determine the mixing profile.

Fruit flavor ingredients shall be delivered using air driven condiment pumps.

Condiment pumps shall be located in the refrigerated space.

Condiment pumps shall be removable for easy access for service.

Condiment pumps shall be energized using solenoid valves mounted in the air flow to the pumps.

Condiment Pumps shall deliver a portioned amount of flavor with an accuracy of ±10%.

The amounts of ingredients used for each smoothie including a total of 8 flavored fluids, water, ice and up to 2 manually added types of additives shall be determined by the Dispense Algorithm.

Mixing

The mixing process includes the actual mixing of the ingredients in a cup and a subsequent cleaning cycle to ensure that the blender's blades are clean for the next mixing cycle.

The mixing operation shall be asynchronous to the dispensing operation.

The mixing operation shall be determined by the current mixing profile and shall take no longer than 20 seconds.

The mixing operation shall consist of 2 steps, blending & washing.

The mixer shall be designed as a module that attaches to the ice machine and refrigerated base.

The mixer module shall consist of a mixer spindle, blade, a linear slide, cup holder with water nozzles.

To access the mixer module a protective door must be raised.

The mixer module door shall contain micro-switches to locate the door position and to provide a lockout.

Mixer Sequence of Operation

The drink is placed into the cup holder and the door is closed.

When the closure of the door has been identified the mixer shall begin the mixing process.

The mixer spindle shall index (via linear slide) down into the drink cup 2.5 inches from home position.

After initial contact the mixer blade shall be energized.

The spindle shall dwell at the initial engagement point for a period of 3 seconds.

The spindle shall then index into the drink to a depth of cup of approximately 75%.

The spindle shall dwell in this location for a period of 15 seconds.

The spindle shall then return to the initial location and continue to mix for a period.

Upon completion the mixer blade shall be de-energized and the spindle returned to its' home location.

The door is then opened and the drink is then removed and served.

Mixer Cleaning Process

After the mixer sequence the module shall begin the cleaning process when the mixer door is closed.

The cleaning process shall start with the spindle being lowered into the mixing cavity and the spindle blade energized.

A water solenoid shall be energized for 3 seconds and begin to spray rinse the spindle and cavity after the spindle blade is energized during a mixer cleaning cycle.

An air solenoid connected to the water line shall be energized to provide a high pressure blast of water during the mixer cleaning cycle.

The module shall be designed to operate with sanitizing agents in addition to water.

The unit shall be able to detect run out of sanitizer fluid.

When the mixer cleaning cycle has ended, the solenoids are de-energized and rinse water is drained.

The mixer cleaning cycle shall take no longer than 5 seconds.

Mixing Profile

A mixing profile determines the steps to be performed during the mixing operation. Each step in the mixing profile specifies spindle's speed and time (how fast for how long) as well as position (with dwell time).

A normal and Additive included mixing profile shall be available for each cup size.

When a non-dispensed-additive is selected, the mixer shall use the Additive mixing profile.

When NO non-dispensed-additives are selected, the mixer shall use the normal mixing profile.

The mixing profiles shall be customer configurable.

User Interface Controller (UIC)

Display use shall be OPTREX F-51851GNFQJ-LY-AND or equivalent.

The UIC shall support handling of USB storage devices formatted with FAT16.

The UIC shall be capable of connecting to the C-Bus.

The UIC shall provide 1-press on-the-fly language switch.

The UIC shall be the P-Bus master.

System Relay Board

Power-up

The relay board shall be responsible for determining the system configuration including fluids loaded and number of blenders and relaying to the Blender control board Blender Control Board Peripheral Bus (P-Bus The peripheral bus or P-Bus shall connect the User Interface Controller to the system's peripherals (the System Relay Board and the Mixer Control Boards).

Physical Layer

The peripheral The P-Bus shall use RS-485.

The peripheral The User Interface Controller shall be the bus master (client).

Protocol

The P-Bus shall use ModBus RTU.

Communication Bus (C-Bus).

Physical Layer

Protocol

User interface and Configuration/Setup Modes

Figure 27:
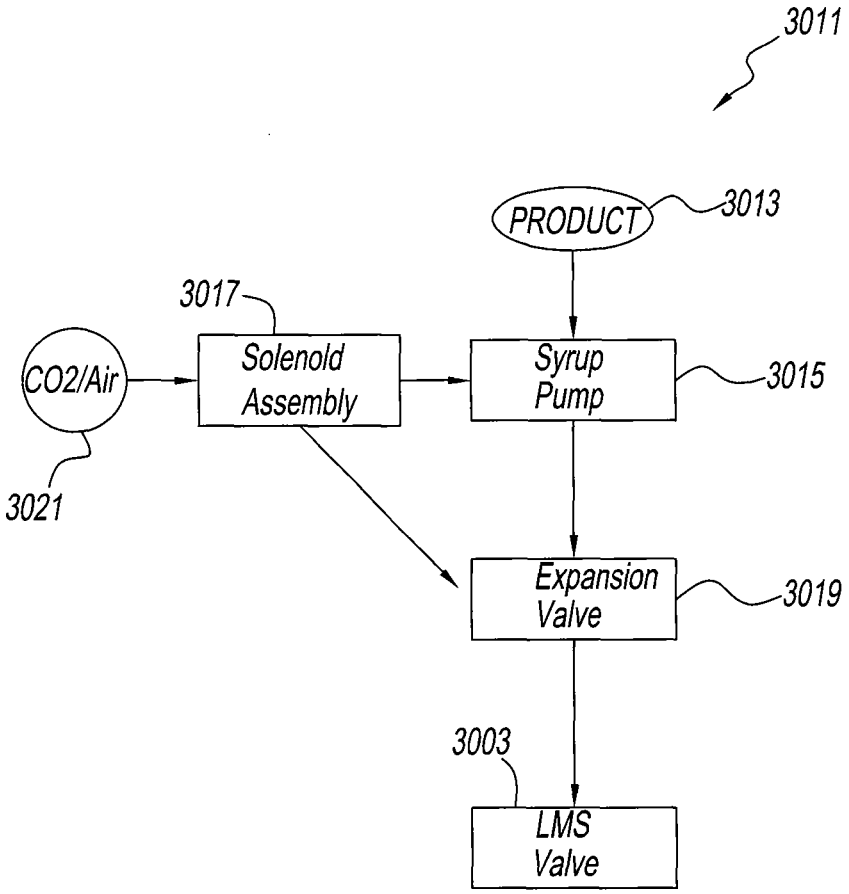
FIG. 27 is a block diagram of the ingredient pumping system used with the ingredient dispensing module in according with the present disclosure.

FIG. 27 is a block diagram of the ingredient pumping system 3011 used with the ingredient dispensing module in according with the present disclosure, wherein a product 3013 is introduced into syrup pump 3015 which is activated by solenoid assembly 3017. Thereafter, syrup is passed from pump 3015 into expansion valve 3019 and simultaneously $CO_2$/air (pressurized) 3021 is passed to expansion valve 3019.

Figure 28A:
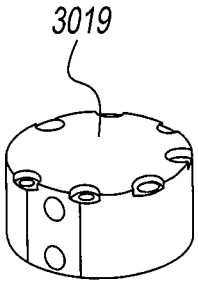
FIG. 28*a* is a front top perspective view of an expansion valve according to the present disclosure.
Figure 28B:
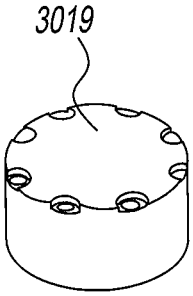
FIG. 28*b* is a back top perspective view of the expansion valve of FIG. 28*a;*
Figure 29:
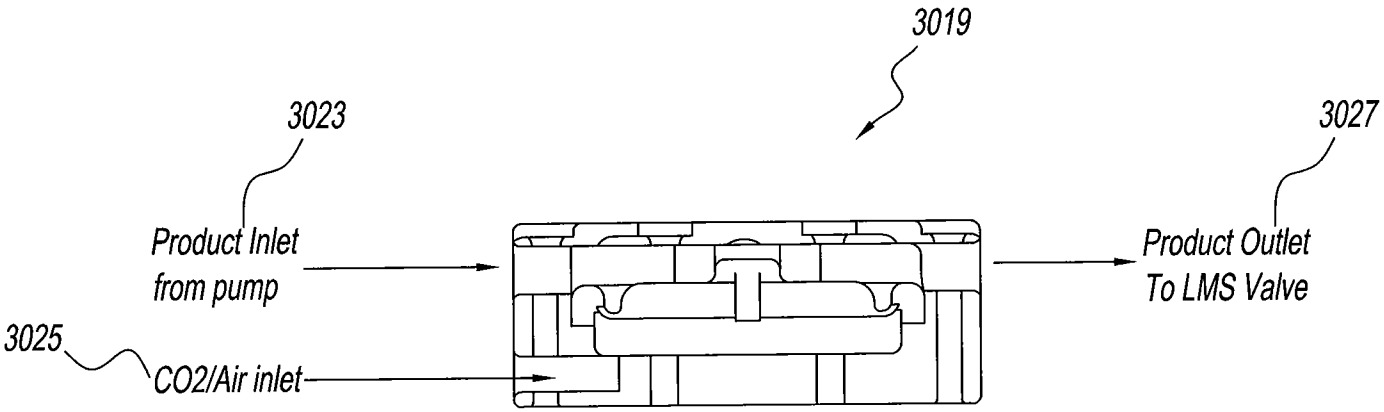
FIG. 29 is a schematic view of the inner chambers of the expansion valve according to the present disclosure.

FIG. 28*a* is a front top perspective view of an expansion valve according to the present disclosure and FIG. 28*b* is a back top perspective view of the expansion valve of FIG. 28*a*. FIG. 29 is a schematic view of the inner chambers of expansion valve 3019 depicting syrup inlet 3023, $CO_2$/air inlet 3025, and product outlet 3027 to LMS valve 3003.

Figure 30:
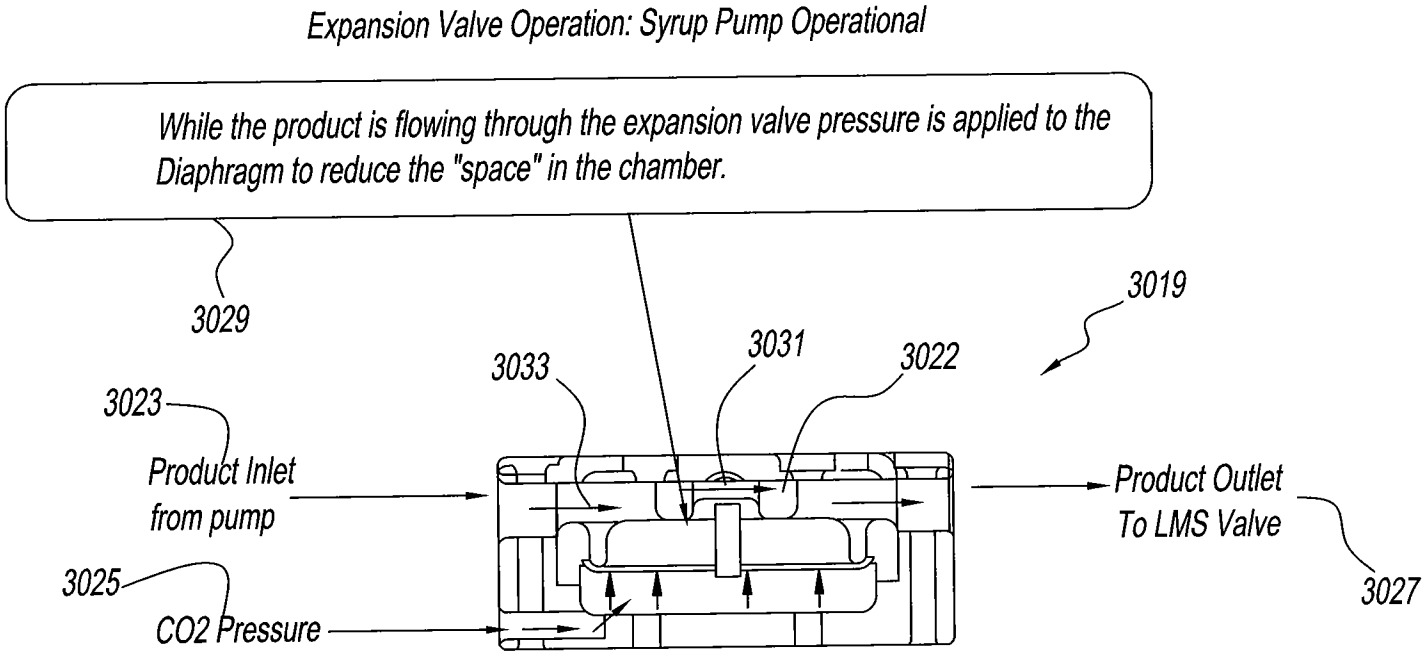
FIG. 30 is a schematic view of the inner chambers of the expansion valve of FIG. 29, wherein ingredients and $CO_2$ are being pumped into the expansion valve and the diaphragm reduces the space in the ingredient chamber or conduit.

FIG. 30 is a schematic view of the inner chambers of expansion valve 3019 of FIG. 29, wherein ingredients and $CO_2$/air are being pumped into expansion valve 3019 and the diaphragm 3029 reduces the space 3031 in ingredient chamber or conduit 3033. Internal bosses 3022 restrict movement of diaphragm 3029 while allowing a fluid passageway around internal bosses 3022.

Figure 31:
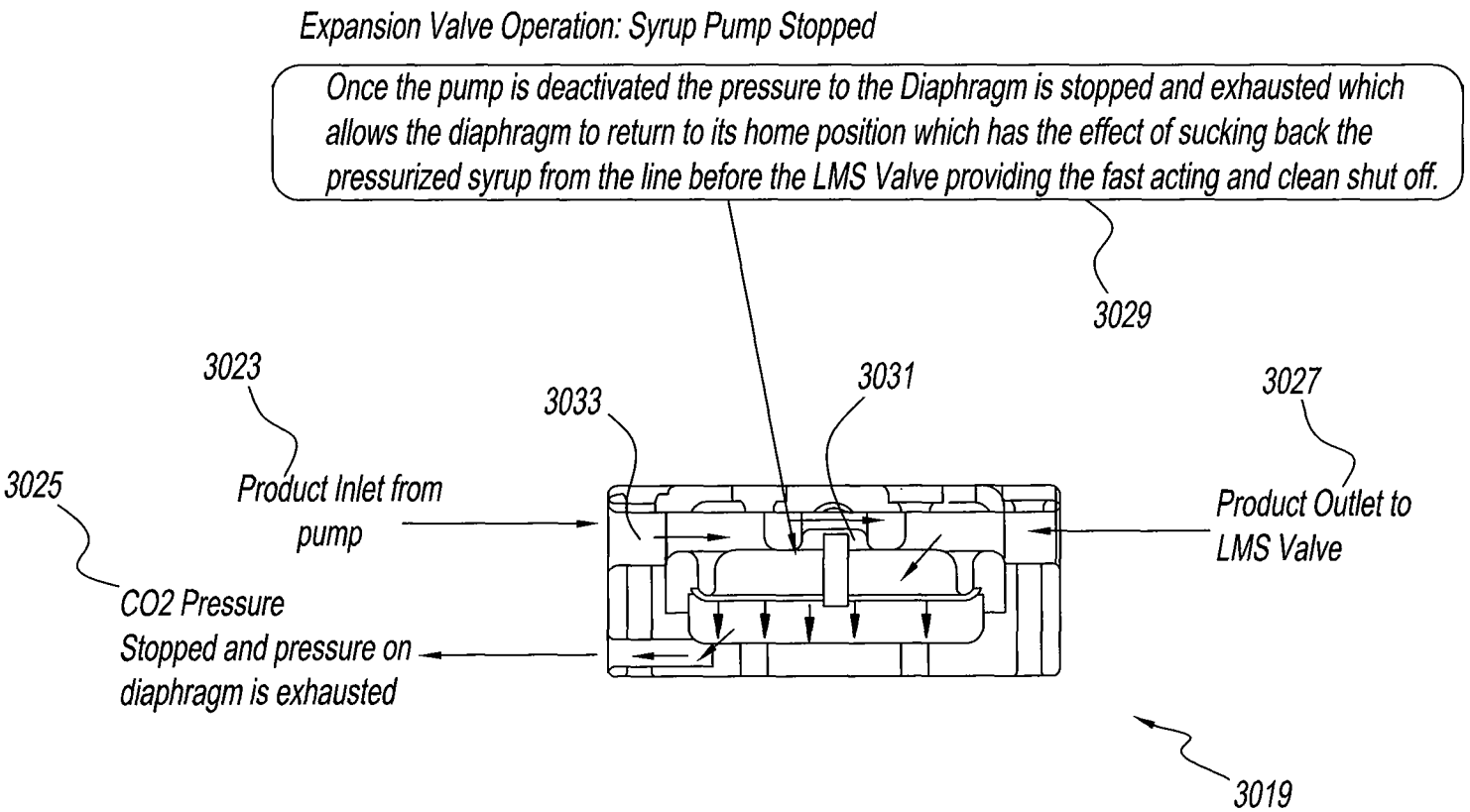
FIG. 31 is a schematic view of the inner chambers of the expansion valve of FIG. 29, wherein the system terminates the pumping of ingredients and $CO_2$ in to the expansion valve and the diaphragm is displaced by the residual pressure in the pump, thereby increasing the space in the ingredient chamber or conduit and the sucking back of the pressurized ingredient.

FIG. 31 is a schematic view of the inner chambers of expansion valve 3019 of FIG. 29, wherein the system terminates the pumping of ingredients and $CO_2$/air into expansion valve 3019 and diaphragm 3029 is displaced by the residual pressure in the pump, thereby increasing the space 3031 in the ingredient chamber or conduit 3033 and the sucking back of the pressurized ingredient.

Figure 32:
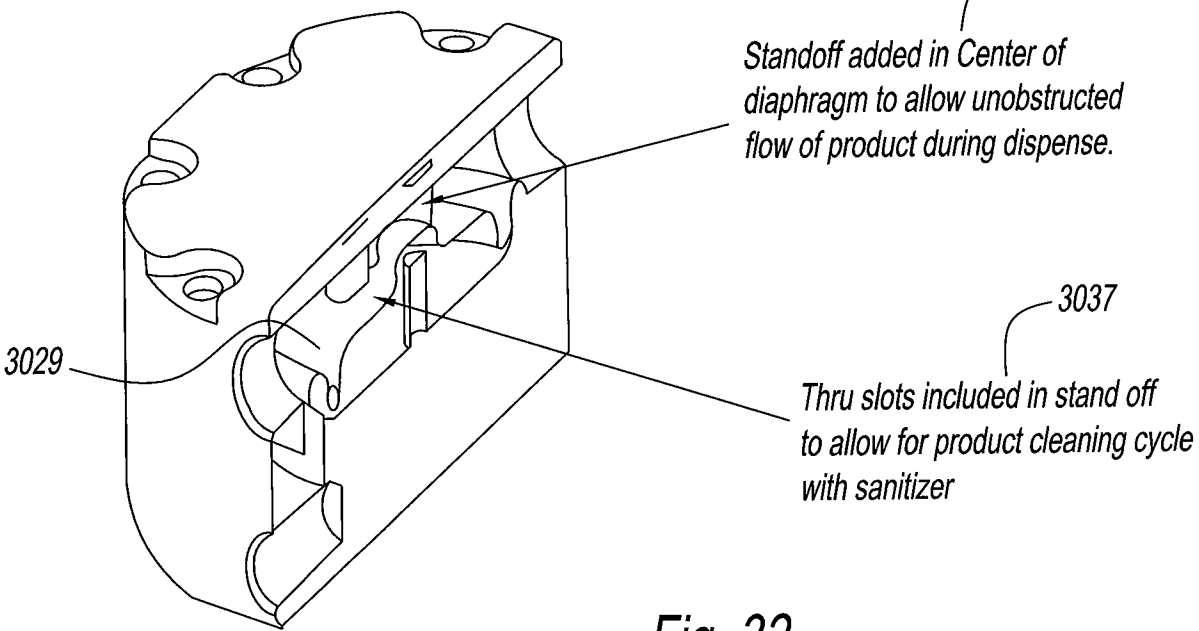
FIG. 32 is a cross-sectional view of the expansion valve of FIG. 28*a;*

FIG. 32 is a cross-sectional view of the expansion valve of FIG. 28*a* depicting a standoff 3035 in the center of diaphragm 3029 to allow unobstructed flow of product during dispense and thru slots 3037 included in standoff 3035 to allow for product cleaning cycle with sanitizer.

Referring back to FIG. 17*b*, expansion valve 3019 is connected to line conduit 1130 in flavor/ingredient dispensing module 1100 so that a first portion 1130*a* of line conduit 1130 is connected to syrup inlet 3023 upstream of expansion valve 3019 and a second portion 1130*b* of line conduit 1130 is connected to product outlet 3027 downstream of expansion valve 3019. Connector 2116 located at the back of holder 2115 can connect the flexible containers within holders 2115 to connection tube 1117, so that the ingredient flows out of the flexible container, into one end of connection tube 1117. Connection tube 1117 of each of holders 1115 is connected to conduit 1119 that is connected to one of pumps 1125 that selectively moves a portion of the ingredient from the flexible container in holders 1115 through connection tube 1117, to conduit 1119, to first portion 1130*a* of line conduit 1130, through expansion valve 3019 to second portion 1130*b* of line conduit 1130 so that the ingredient can flow to dispenser nozzle 1304 to dispense the ingredient out of assembly 100, for example, to cup 15. A source of $CO_2$ or compressed air 5050 is connected to a valve 5052 that is connected to pump 1125 via a conduit 5054 and $CO_2$/air inlet 3025 via conduit 5056, e.g., a valve that includes a solenoid that opens a first passage for the $CO_2$/air to pass into conduits 5054, 5056 in a first position and closes the passage for the $CO_2$/air to pass into conduits 5054, 5056 in a second position while opening a second passage for exhaust in the second position. Alternatively, expansion valve 3019 may be retrofitted into a flavor/ingredient dispensing module, for example, flavor/ingredient dispensing module 1100 by placing the expansion valve 3019 along the flow path of the ingredient from the flexible container in holders 1115 to dispenser nozzle 1304.

In operation, when pump 1125 is activated, valve 5052 connects conduit 5056 and source of CO2 or compressed air 5050 so that $CO_2$/air flows through conduit 5056 into expansion valve 3019 through $CO_2$/air inlet 3025 and the diaphragm 3029 reduces the space 3031 in ingredient chamber or conduit 3033, valve 5052 connects conduit 5054 and source of CO2 or compressed air 5050 so that $CO_2$/air flows through conduit 5054 to selectively move a portion of the ingredient from the flexible container in holders 1115 through connection tube 1117, to conduit 1119, to first portion 1130*a* of line conduit 1130, through expansion valve 3019, having space 3031 that is reduced by diaphragm 3029, to second portion 1130*b* of line conduit 1130 that then flows to dispenser nozzle 1304 to dispense the ingredient out of assembly 100. When pump 1125 is deactivated, valve 5052 terminates flow of $CO_2$/air through conduit 5054 to pumps 1125 and valve 5052 terminates flow of $CO_2$/air through conduit 5056 to expansion valve 3019 and diaphragm 3029 is displaced by the residual pressure in pumps 1125, thereby increasing the space 3031 in the ingredient chamber or conduit 3033 and the sucking back of the portion of the ingredient from the flexible container in holders 1115. Increasing the space 3031 in the ingredient chamber or conduit 3033 of expansion valve 3019 sucks back the portion of the ingredient from the flexible container in holders 1115 to minimize or prevent dispensing of the ingredient from the flexible container in holders 1115 out of assembly 100 once pumps 1125 are deactivated.

Figure 33:
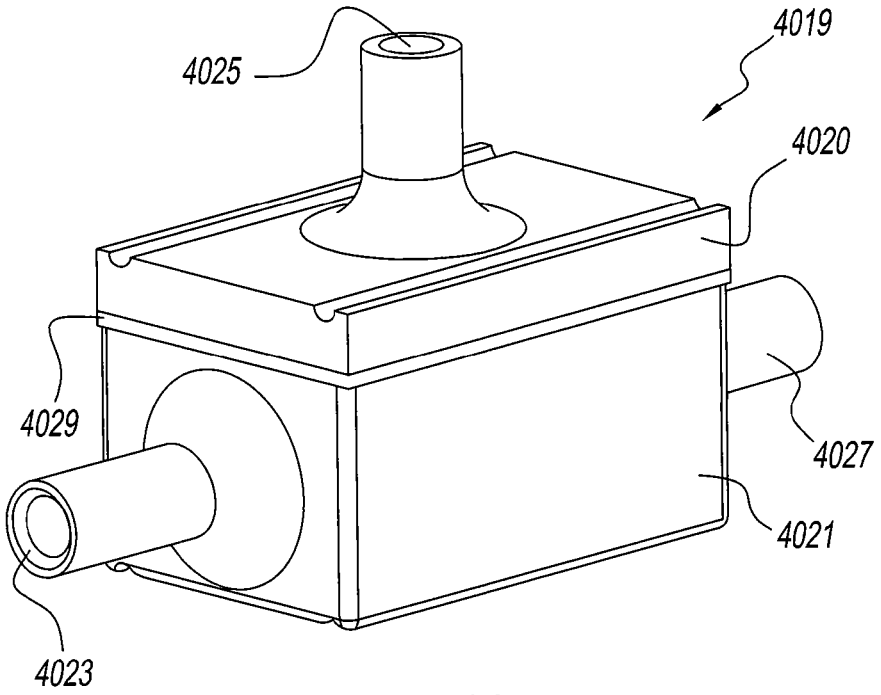
FIG. 33 is a front top perspective view of an expansion valve according to the present disclosure.
Figure 34:
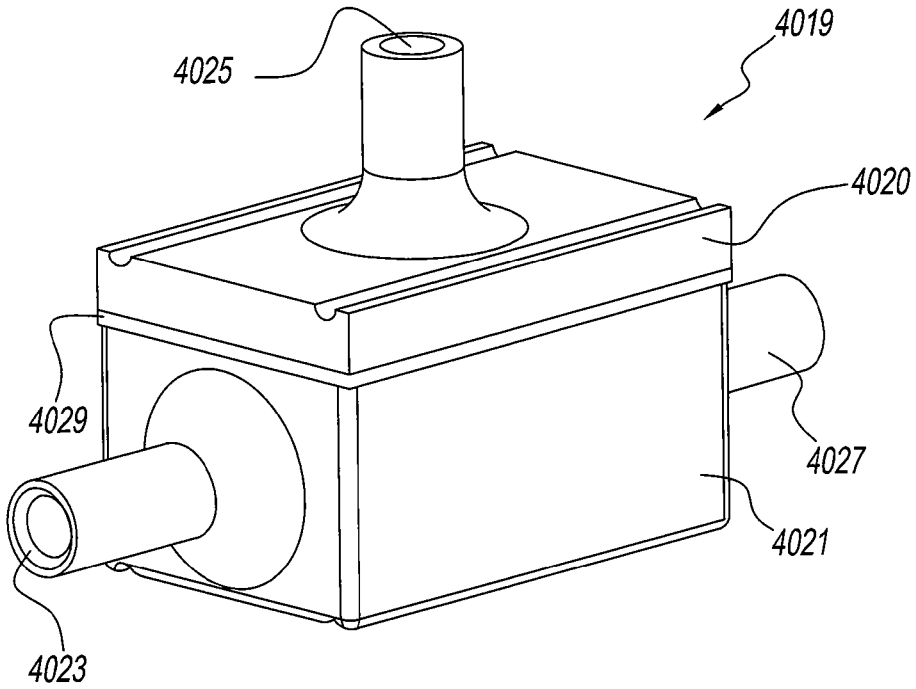
FIG. 34 is a front top perspective view of the expansion valve of FIG. 33.
Figure 35:
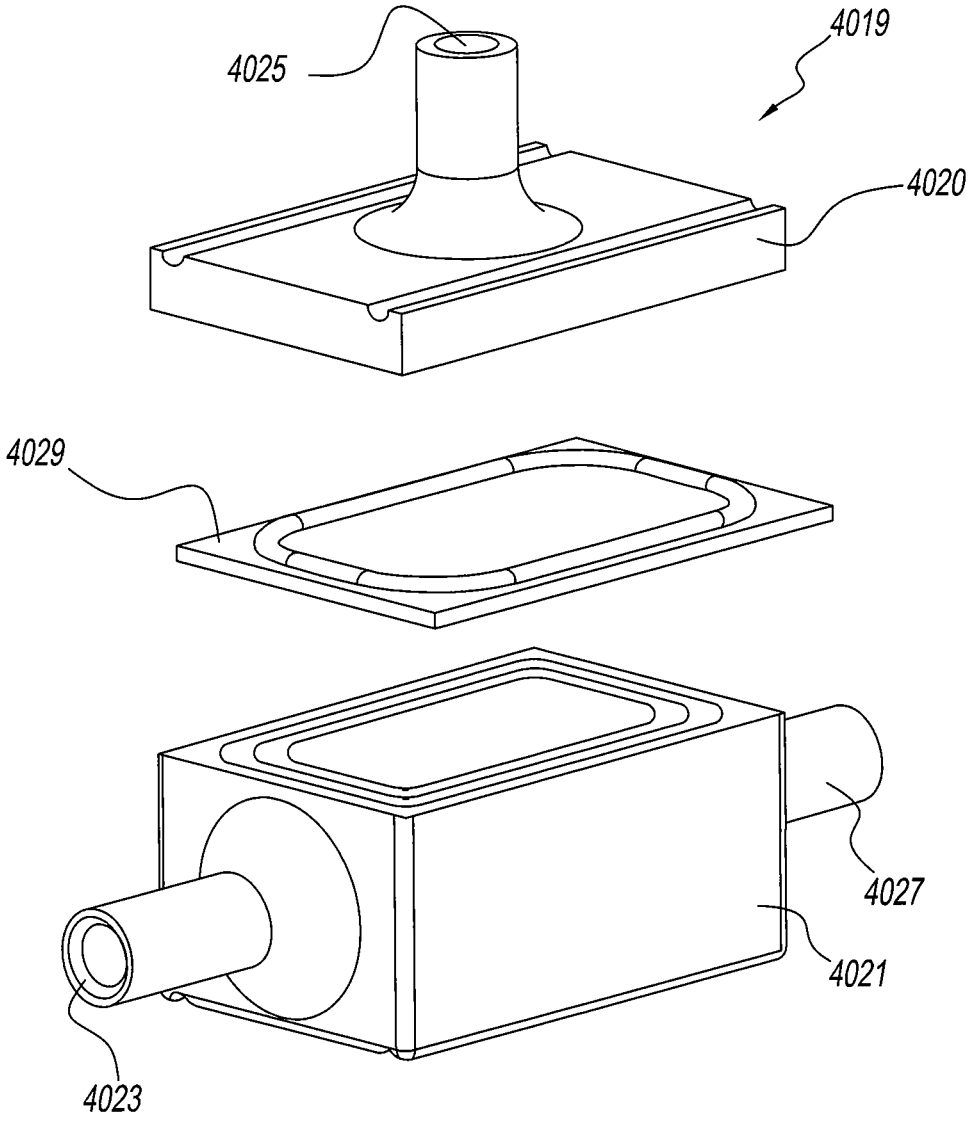
FIG. 35 an exploded view of the expansion valve of FIG. 33.

FIGS. 33-35 are views of an expansion valve according to the present disclosure referred to by reference numeral 4019. Expansion valve 4019 has a top housing 4020, a bottom housing 4021, and a membrane 4029. Bottom housing 4021 has a syrup inlet 4023 and product outlet 4027 to LMS valve 3003. Top housing 4020 has $CO_2$/air inlet 4025. Similar to expansion valve 3019, expansion valve 4019 may be connected to line conduit 1130 in flavor/ingredient dispensing module 1100 so that first portion 1130*a* of line conduit 1130 is connected to syrup inlet 4023 upstream of expansion valve 4019, second portion 1130*b* of line conduit 1130 is connected to product outlet 4027 downstream of expansion valve 4019, and conduit 5056 is connected to $CO_2$/air inlet 4025. Top housing 4020 is connected to bottom housing 4021 with membrane 4029 secured between top housing 4020 and bottom housing, for example, by screws.

Figure 36:
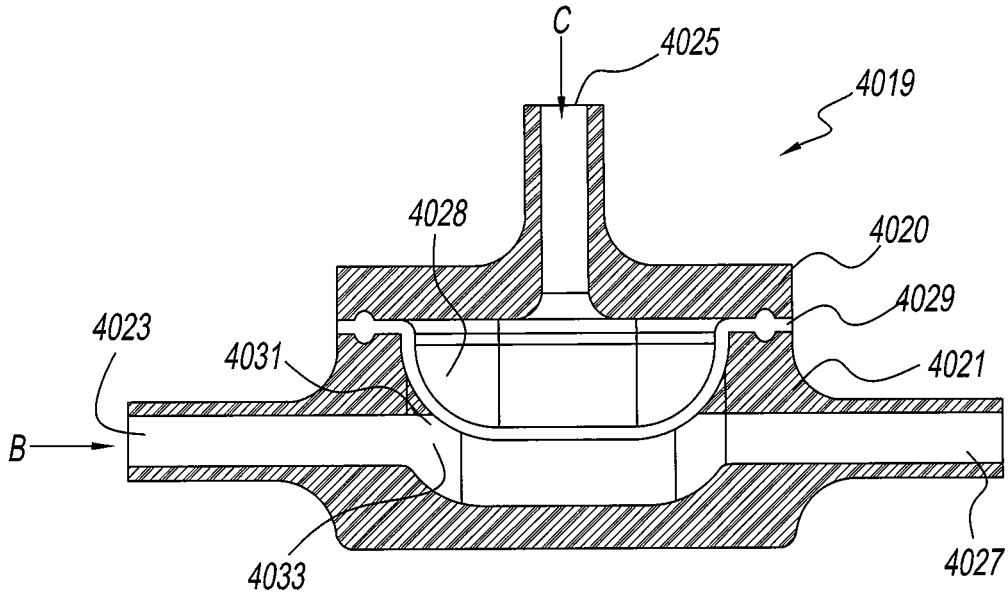
FIG. 36 is a side cross sectional view of the inner chambers of the expansion valve of FIG. 33, wherein ingredients and $CO_2$ are being pumped into the expansion valve and a membrane reduces the space in the ingredient chamber or conduit.
Figure 37:
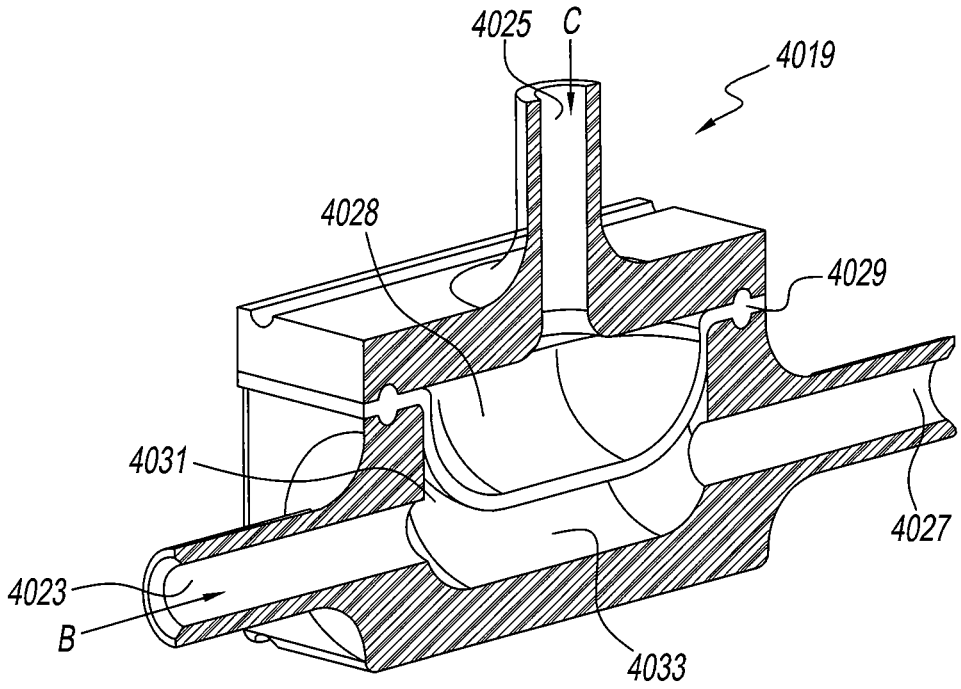
FIG. 37 is a top front perspective view of FIG. 36.

As shown in FIGS. 36 and 37, top housing 4020, bottom housing 4021, and membrane 4029 form an inner chamber 4028 and an ingredient chamber or conduit 4033 of expansion valve 4019. The inner chamber 4028 and ingredient chamber or conduit 4033 are separated by membrane 4029. Membrane 4029 is a flexible material that can be inflated or deflated. Ingredients are pumped into syrup inlet 4023, as shown by arrow B, and $CO_2$/air is flowed into inner chamber 4028 through $CO_2$/air inlet 4025, as shown by arrow C, so that membrane 4029 is inflated to reduce a space 4031 in ingredient chamber or conduit 4033.

Figure 38:
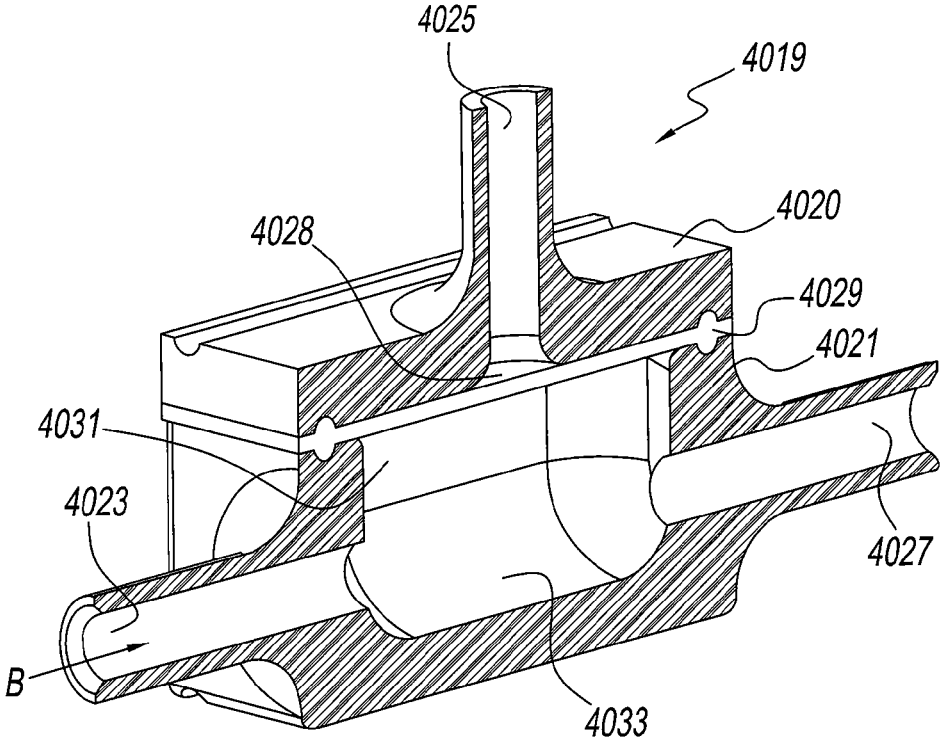
FIG. 38 is a front perspective cross sectional view of the inner chambers of the expansion valve of FIG. 33, wherein the system terminates the pumping of ingredients and $CO_2$ in to the expansion valve and the membrane is displaced by the residual pressure in the pump, thereby increasing the space in the ingredient chamber or conduit and sucking back the pressurized ingredient.
Figure 39:
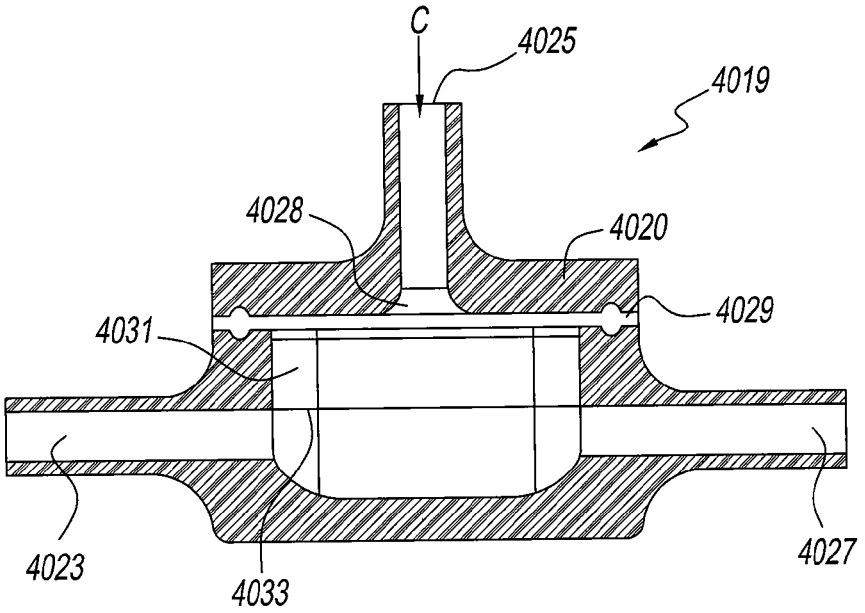
FIG. 39 is a side view of FIG. 38.

As shown in FIGS. 38 and 39, where the system 3011, or valve 5052, terminates the pumping of ingredients through syrup inlet 4023 and $CO_2$/air terminates flowing $CO_2$/air into inner chamber 4028, membrane 4029 is deflated to return to a home position, thereby increasing the space 4031 in the ingredient chamber or conduit 4033 and sucking back the pressurized ingredient. The ingredients can be fluid that is allowed to expand into space 4031 that is enlarged when the system terminates the pumping of ingredients and $CO_2$/air into inner chamber 4028 and membrane 4029 is deflated to return to the home position.

Figure 40:
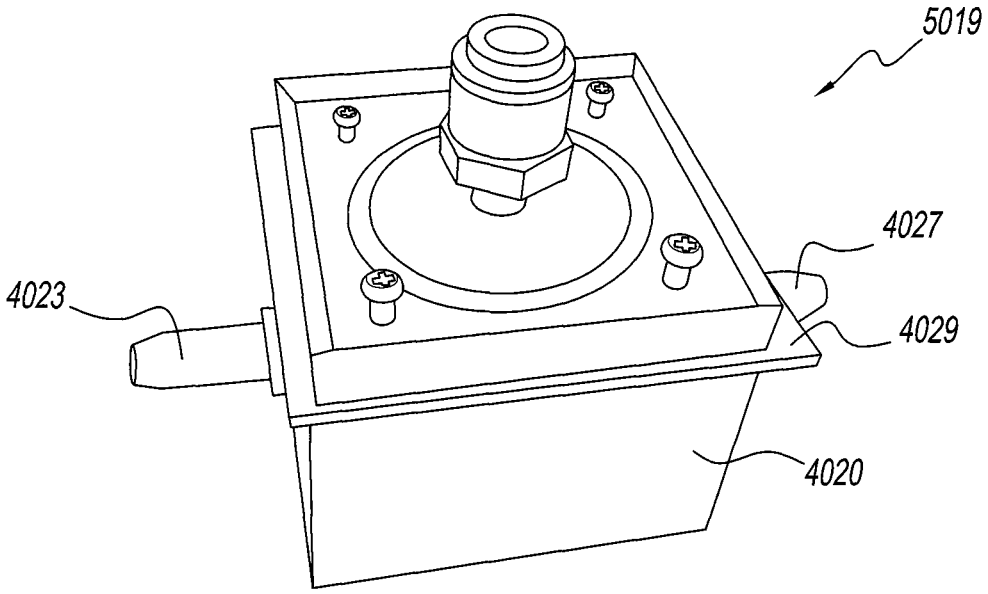
FIG. 40 is a front top perspective view of an expansion valve according to the present disclosure.
Figure 41:
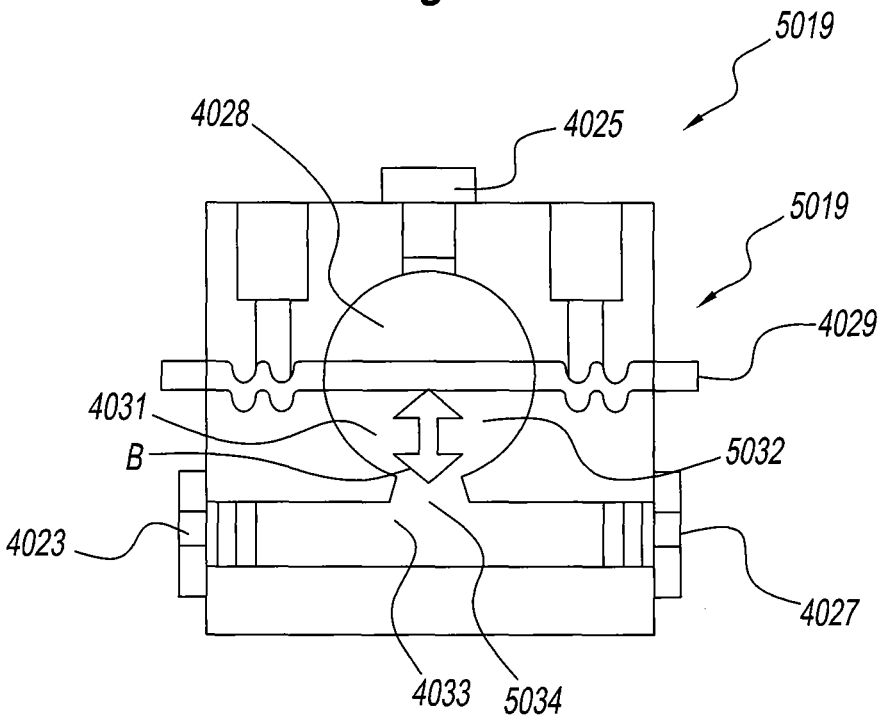
FIG. 41 is a schematic view of the inner chambers of the expansion valve of FIG. 40 wherein the system terminates the pumping of ingredients and $CO_2$ in to the expansion valve and the membrane is displaced by the residual pressure in the pump, thereby sucking back of the pressurized ingredient.

FIGS. 40 and 41 show another expansion valve according to the present disclosure referred to by reference numeral 5019. Expansion valve 5019 is similar to expansion valve 4019 except expansion valve 4019 allows expansion of membrane 4029 to take place in the direct flow system or directly adjacent ingredient chamber or conduit 4033 whereas expansion valve 5019 includes a volume 5032 outside of a main flow of the ingredients in ingredient chamber or conduit 4033 and is connected to ingredient chamber or conduit 4033 by a connection conduit 5034.

Figure 42:
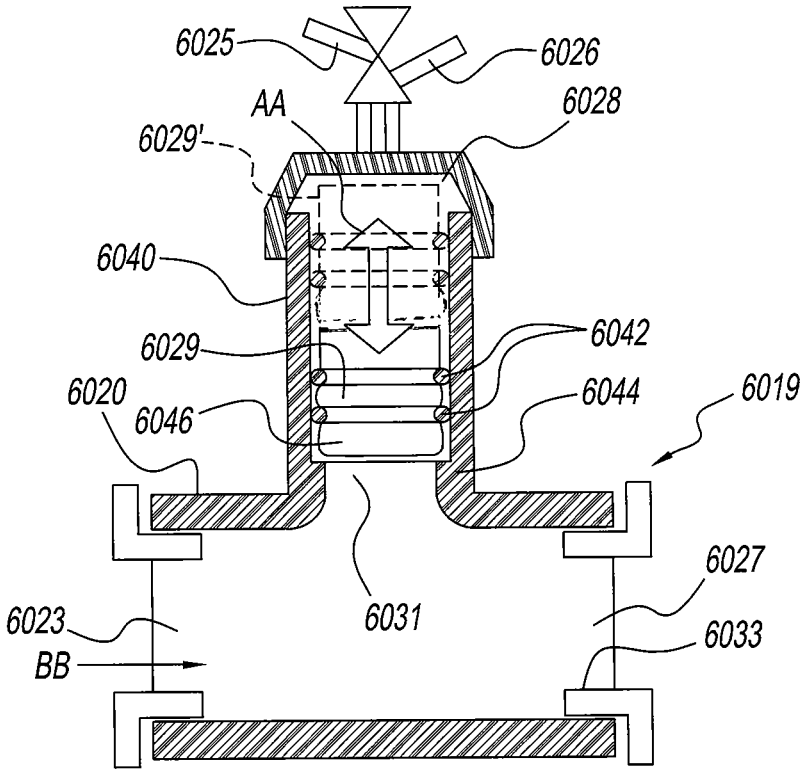
FIG. 42 is a schematic view of the inner chambers of an expansion valve according to the present disclosure, wherein ingredients and $CO_2$ are being pumped into the expansion valve and a piston in solid lines reduces the space in the ingredient chamber or conduit, and wherein the system terminates the pumping of ingredients and $CO_2$ in to the expansion valve and the piston shown in broken lines is displaced by the residual pressure in the pump, thereby increasing the space in the ingredient chamber or conduit and sucking back of the pressurized ingredient.

FIG. 42 is a schematic view of another expansion valve according to the present disclosure referred to by reference numeral 6019. Expansion valve 6019 has a housing 6020. Housing 6020 has a syrup inlet 6023, $CO_2$/air inlet 6025, $CO_2$/air vent 6026, and product outlet 6027 to LMS valve 3003. Similar to expansion valve 3019, expansion valve 6019 may be connected to line conduit 1130 in flavor/ingredient dispensing module 1100 so that first portion 1130*a* of line conduit 1130 is connected to syrup inlet 6023 upstream of expansion valve 6019, second portion 1130*b* of line conduit 1130 is connected to product outlet 6027 downstream of expansion valve 6019, and conduit 5056 is connected to $CO_2$/air inlet 6025. An inner chamber 6028 and an ingredient chamber or conduit 6033 are in housing 6020 and are separated in housing 6020 by a piston 6029. Piston 6029 is movable in a casing 6040 formed by housing 6020. Piston 6029 has O-ring seals 6042 that provide a seal between piston 6029 and casing 6040. Casing 6040 forms a seat 6044. Piston 6029 has a seat portion 6046 that is sized to abut seat 6044. Ingredients pumped into syrup inlet 6023, as shown by arrow BB, and $CO_2$/air is pumped into and $CO_2$/air inlet 6025 so that piston 6029 is moved toward ingredient chamber or conduit 6033, as shown by arrow AA, to abut seat 6044 reducing a space 6031 in ingredient chamber or conduit 6033. When the system terminates the pumping of ingredients through syrup inlet 6023 and terminates flowing $CO_2$/air into inner chamber 6028 fluid pressure of the ingredients push piston 6029 so that air pressure behind piston 6029 is exhausted through $CO_2$/air vent 6026 and piston 6029 moves toward $CO_2$/air vent 6026, as shown by piston 6029' in broken lines and arrow AA, relieving volumetric space for the ingredients that are fluid to expand.

Figure 43:
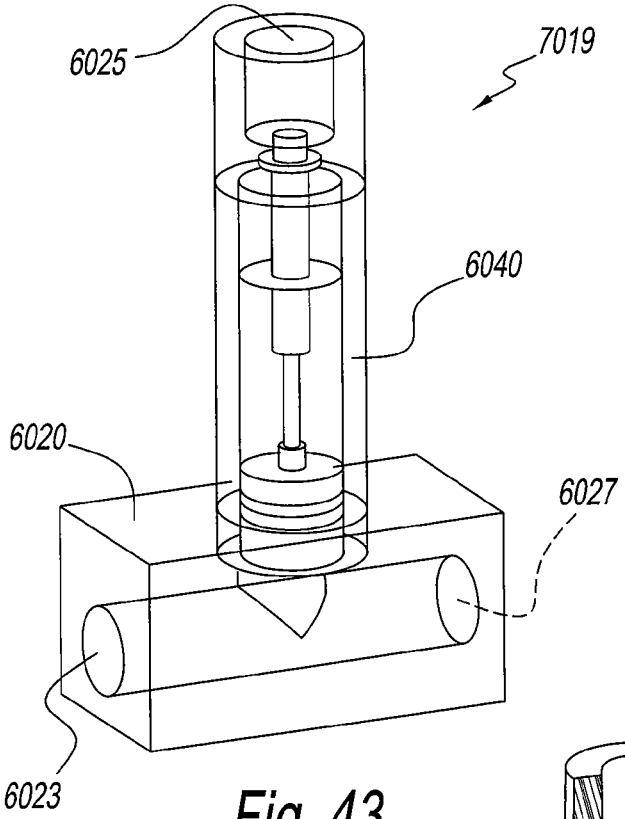
FIG. 43 is a schematic view of an expansion valve according to the present disclosure, wherein ingredients and $CO_2$ are being pumped into the expansion valve and a piston reduces the space in the ingredient chamber or conduit.
Figure 44:
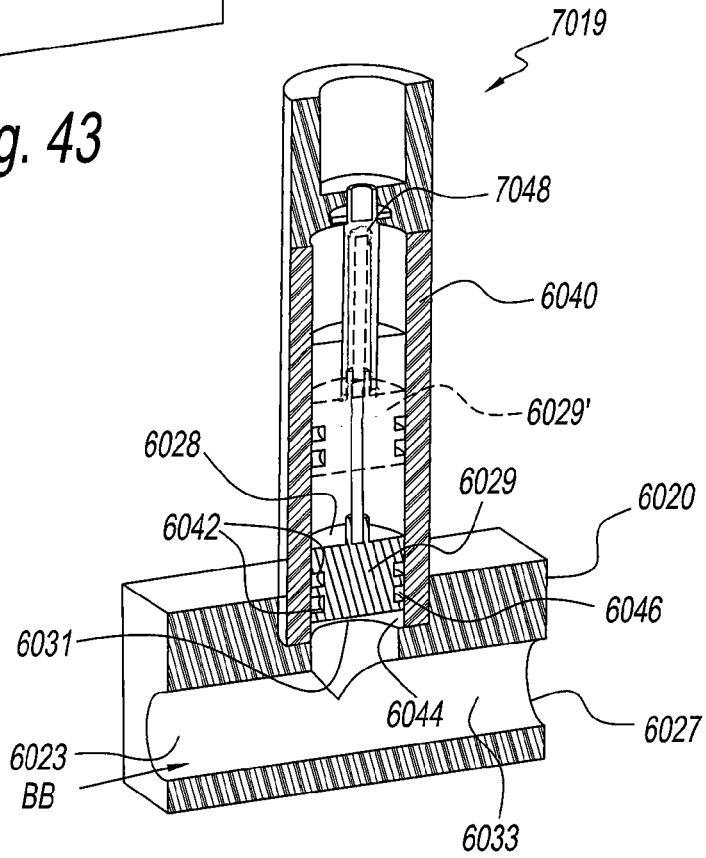
FIG. 44 is a schematic view of the inner chambers of the expansion valve of FIG. 43, wherein ingredients and $CO_2$ are being pumped into the expansion valve and a piston in solid lines reduces the space in the ingredient chamber or conduit, and wherein the system terminates the pumping of ingredients and $CO_2$ in to the expansion valve and the piston shown in broken lines is displaced, thereby increasing the space in the ingredient chamber or conduit and the sucking back of the pressurized ingredient.

FIGS. 43 and 44 show another expansion valve according to the present disclosure referred to by reference numeral 7019. Expansion valve 7019 is similar to expansion valve 6019 except expansion valve 7019 utilizes a pneumatic cylinder 7048 to extend piston 6029. $CO_2$/air enters the pneumatic cylinder through inlet 6025. Air cylinder 7048 may use a spring or air pressure to move piston 6029 as shown in broken lines.

Figure 45:
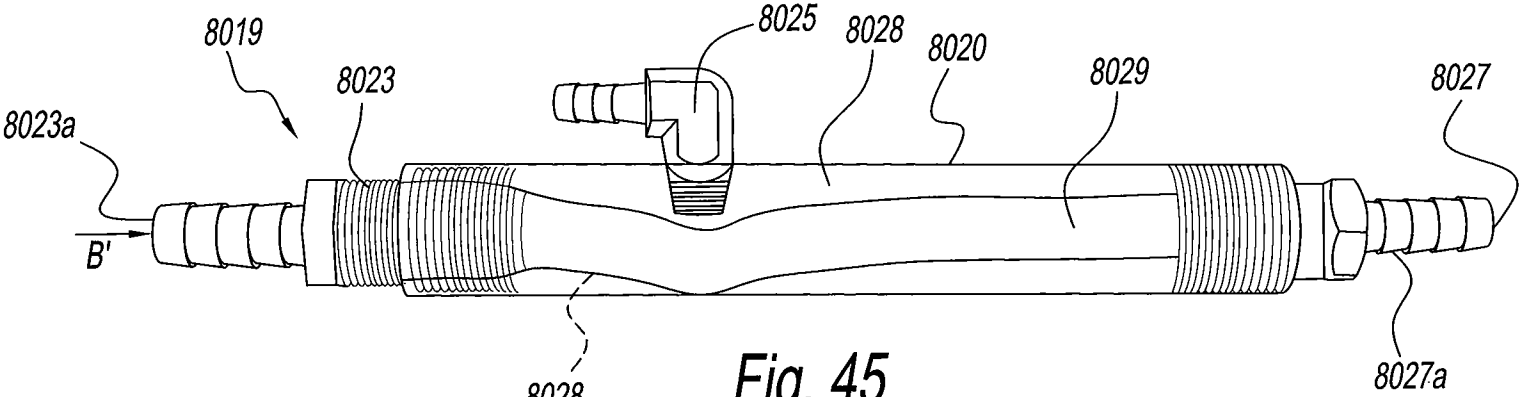
FIG. 45 is a front top perspective view of an expansion valve according to the present disclosure, wherein ingredients and $CO_2$ are being pumped into the expansion valve and a flexible tube reduces the space in the ingredient chamber or conduit.
Figure 46:
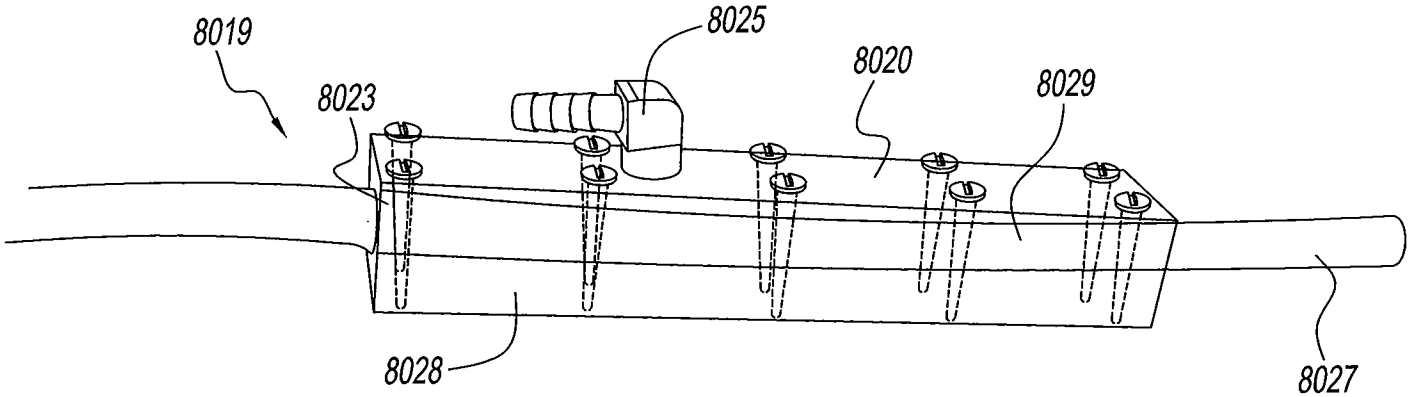
FIG. 46 is a front top perspective view of an expansion valve according to the present disclosure, wherein the system terminates the pumping of ingredients and $CO_2$ in to the expansion valve and the flexible tube is displaced by the residual pressure in the pump, thereby increasing the space in the flexible tube and sucking back of the pressurized ingredient.
Figure 47:
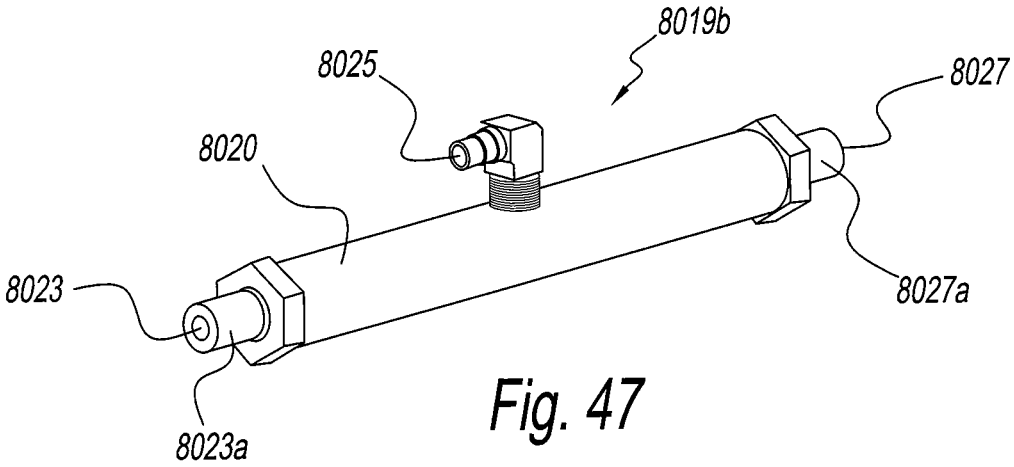
FIG. 47 is a front top perspective view of an expansion valve according to the present disclosure.
Figure 48:
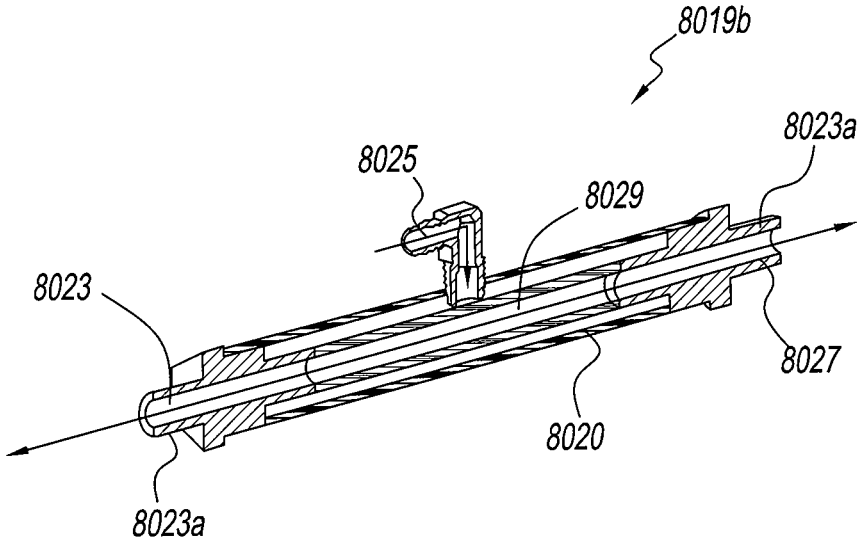
FIG. 48 is a front perspective cross sectional view of the expansion valve of FIG. 47.
Figure 49:
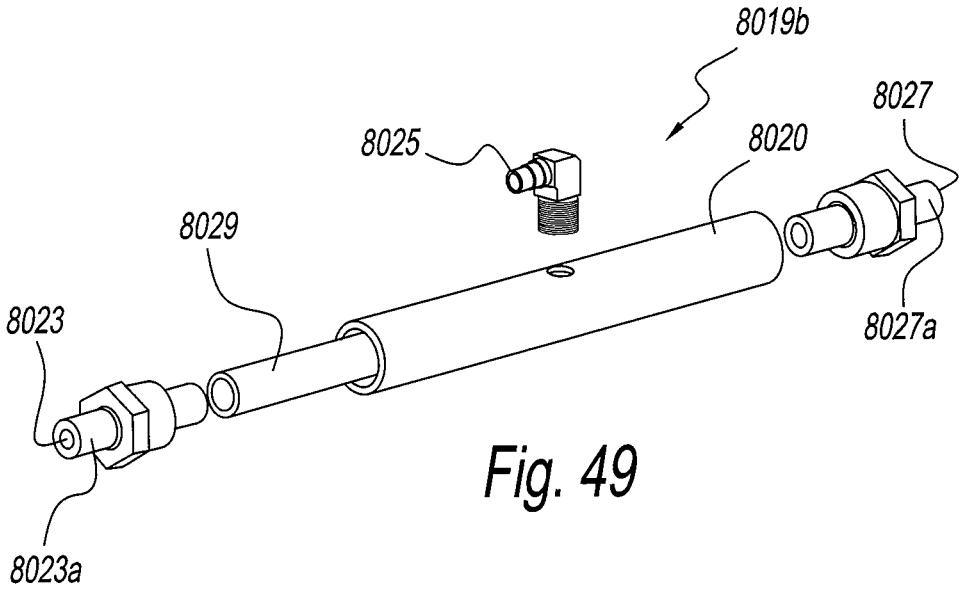
FIG. 49 is a front perspective exploded view of the expansion valve of FIG. 47.
Figure 50:
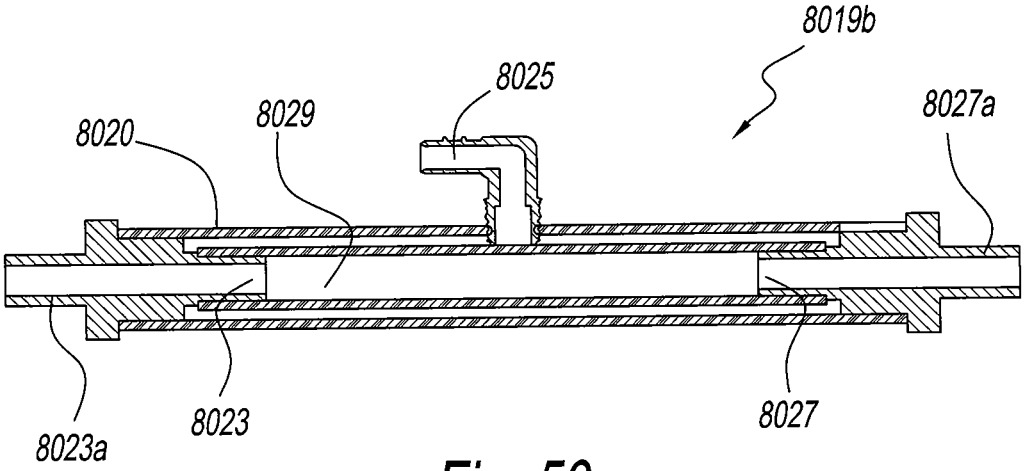
FIG. 50 is a side cross sectional view of the expansion valve of FIG. 47.
Figure 51:
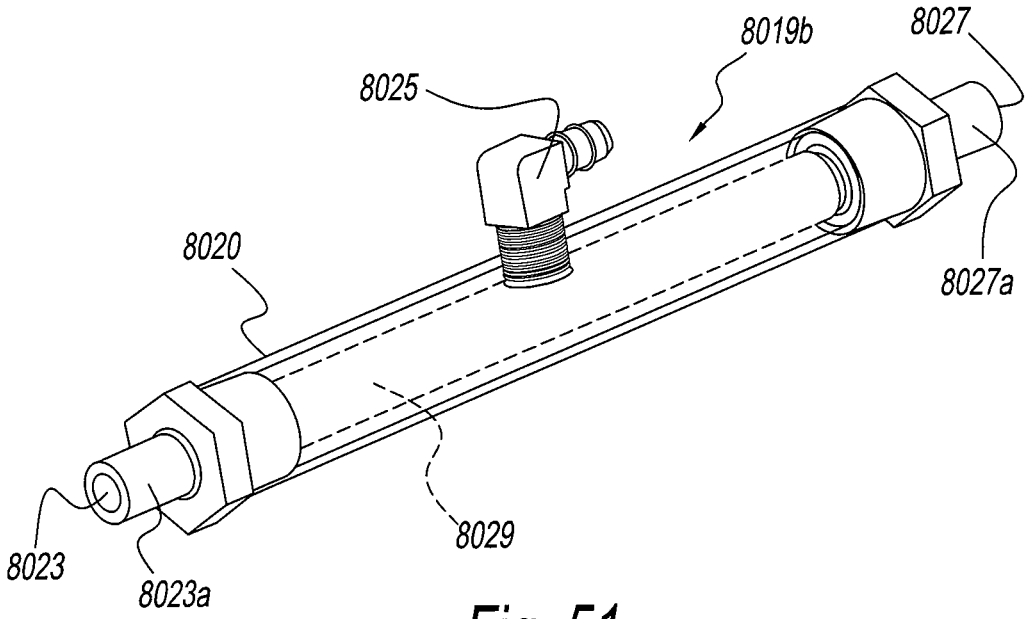
FIG. 51 is a front top perspective view of an expansion valve according to the present disclosure.

FIGS. 45 and 46 are front top perspective views of expansion valves according to the present disclosure referred to by reference numeral 8019 and 8019*a*. Expansion valves 8019 and 8019*a* are similar except for shape of a housing 8020 and expansion valve 8019*a* does not show a syrup inlet fitting 8023*a* or a product outlet fitting 8027*a*. Expansion valve 8019 has a housing 8020. Housing 8020 has a syrup inlet 8023, $CO_2$/air inlet 8025, and product outlet 8027 to LMS valve 3003. Similar to expansion valve 3019, expansion valves 8019 and 8019*a* may be connected to line conduit 1130 in flavor/ingredient dispensing module 1100 so that first portion 1130*a* of line conduit 1130 is connected to syrup inlet 8023 upstream of expansion valves 8019 and 8019*a*, second portion 1130*b* of line conduit 1130 is connected to product outlet 8027 downstream of expansion valves 8019 and 8019*a*, and conduit 5056 is connected to $CO_2$/air inlet 8025. Syrup inlet 8023 is formed by syrup inlet fitting 8023*a* that connects to flexible tube 8029 and housing 8020. Product outlet 8027 is formed by product outlet fitting 8027*a* that connects flexible tube 8029 and housing 8020.

As shown in FIG. 45, ingredients are pumped into syrup inlet 8023, as shown by arrow B' and $CO_2$/air is flowed through $CO_2$/air inlet 8025 into an inner chamber 8028 formed between housing 8020 and flexible tube 8029 so that flexible tubing 8029 is compressed to compress a volume inside of flexible tube 8029.

As shown in FIG. 46, the system terminates the pumping of ingredients through syrup inlet 8023 and $CO_2$/air terminates flowing $CO_2$/air into inner chamber 8028 so that flexible tube 8029 is allowed to expand back to normal increasing the volume available for the ingredients flowing through flexible tube 8029. The ingredients can be fluid that is allowed to expand in flexible tubing 8029 that is enlarged when the system terminates the pumping of ingredients and $CO_2$/air into inner chamber 8028.

FIGS. 47-51 show an expansion valve according to the present disclosure referred to by reference numeral 8019*b*. Expansion valves 8019 and 8019*b* are similar except for materials and dimensions.

Figure 52:
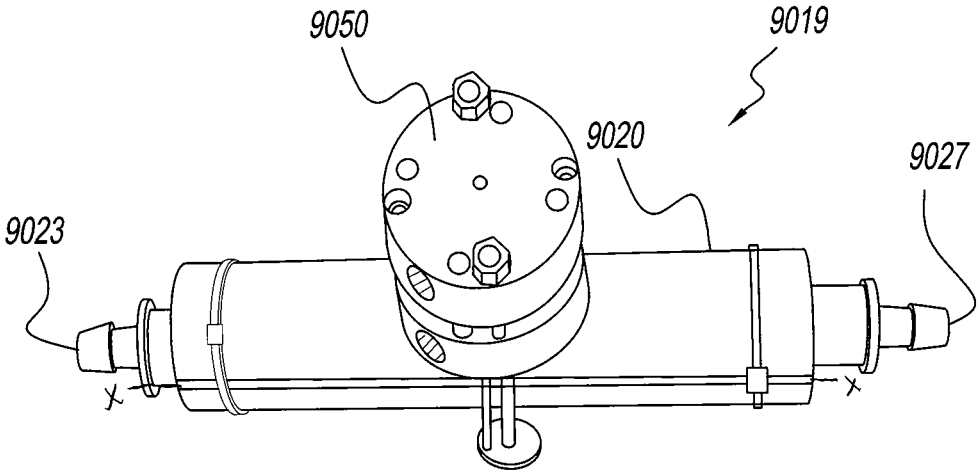
FIG. 52 is a front top perspective view of an expansion valve according to the present disclosure.

As shown in FIG. 52, an expansion valve 9019 has a pneumatic cylinder 9050, a housing 9020, a syrup inlet 9023 and a product outlet 9027. Similar to expansion valve 3019, expansion valve 9019 may be connected to line conduit 1130 in flavor/ingredient dispensing module 1100 so that first portion 1130*a* of line conduit 1130 is connected to syrup inlet 9023 upstream of expansion valve 9019 and second portion 1130*b* of line conduit 1130 is connected to product outlet 9027 downstream of expansion valve 9019.

Figure 53:
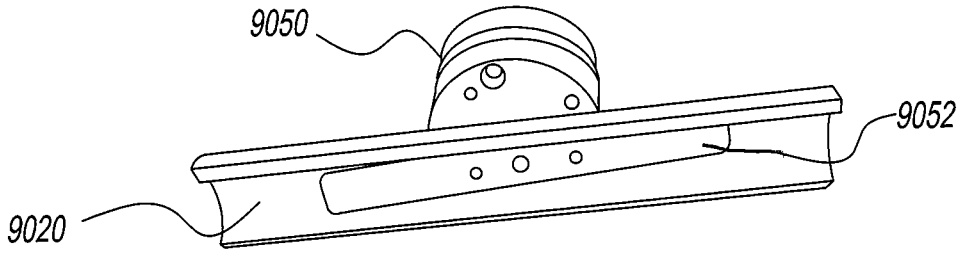
FIG. 53 is a partial bottom perspective view of the expansion valve of FIG. 52 wherein a housing is separated along line X of FIG. 52.

As shown in FIG. 53, pneumatic cylinder 9050 is connected to a shoe 9052 that is in housing 9020.

Figure 54:
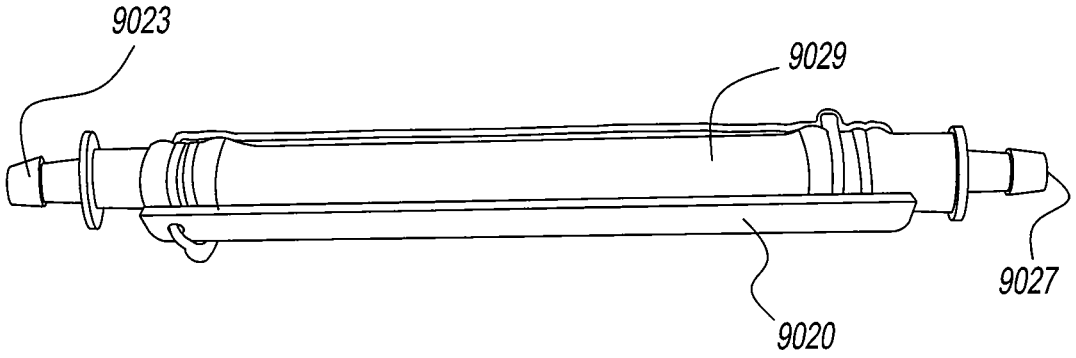
FIG. 54 is a partial top perspective view of the expansion valve of FIG. 52 wherein the housing is separated along line X of FIG. 52.

As shown in FIG. 54, a flexible tube 9029 is in housing 9020. Flexible tube 9029 receives ingredients from syrup inlet 9023 that flows through flexible tube 9029 to product outlet 9027. Pneumatic cylinder 9050 moves shoe 9052 to compress a section of flexible tubing 9029 connected to the product line. The flexible tube 9029 is contained in housing 9020 and is compressed by shoe 9052 connected to pneumatic cylinder 9050. Pneumatic cylinder 9050 is driven by the same pressure source as pump 3015 or pumps 1125, e.g., pneumatic cylinder 9050 has a $CO_2$/air inlet and conduit 5056 is connected to the $CO_2$/air inlet. This allows volume in flexible tube 9029 to decrease while ingredient pumping system 3011 or pumps 1125 is dispensing, once the dispense ends pneumatic cylinder 9050 moves shoe 9052 away from flexible tube 9029 and flexible tube 9029 expands to its original shape increasing the volume in flexible tube 9029.

Expansion valves 4019, 5019, 6019, 7019, 8019, 8019*a*, 8019*b*, and 9019 allow for an area of expansion of the ingredients once the flow of $CO_2$/air is terminated to the system. This expansion draws the ingredients away from discharge from the LMS valve 3003 by creating a low pressure area. The ingredients are pulled into the newly expanded area eliminating dripping and errant spray from the LMS valve 3003.

Expansion valves 4019, 5019, 6019, 7019, 8019, 8019*a*, 8019*b*, and 9019 can be used for fluids that are compressible and fluids containing particulate which are boundaries to common fluid control devices such as solenoids and check valves. This new advantage allows for use in food applications where other mechanisms could not be used.

Figure 55:
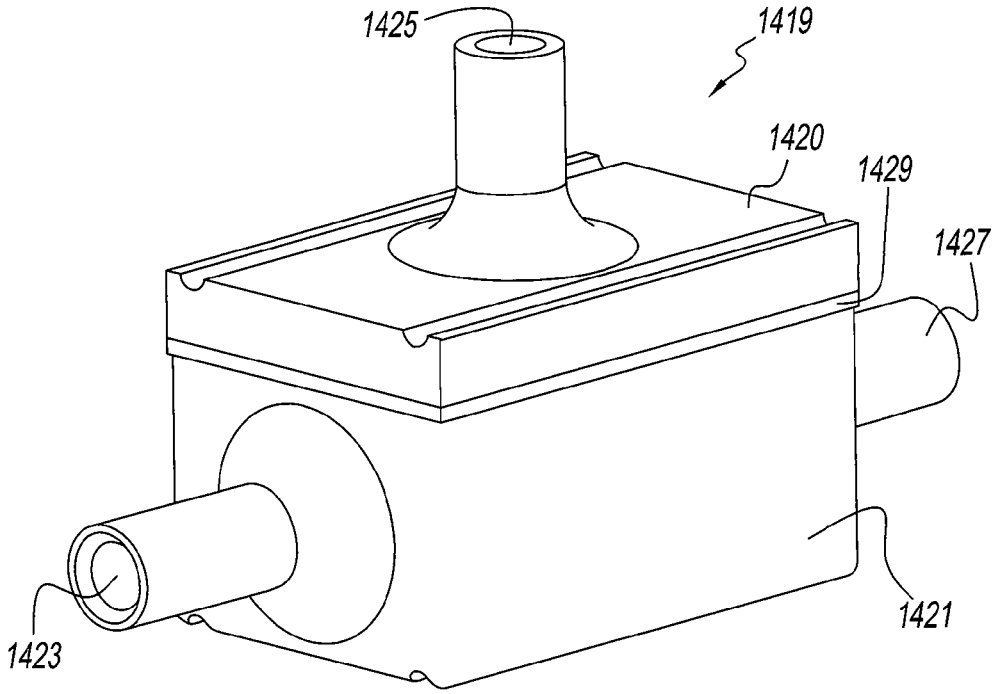
FIG. 55 is a front top perspective view of a non-return valve according to the present disclosure.
Figure 56:
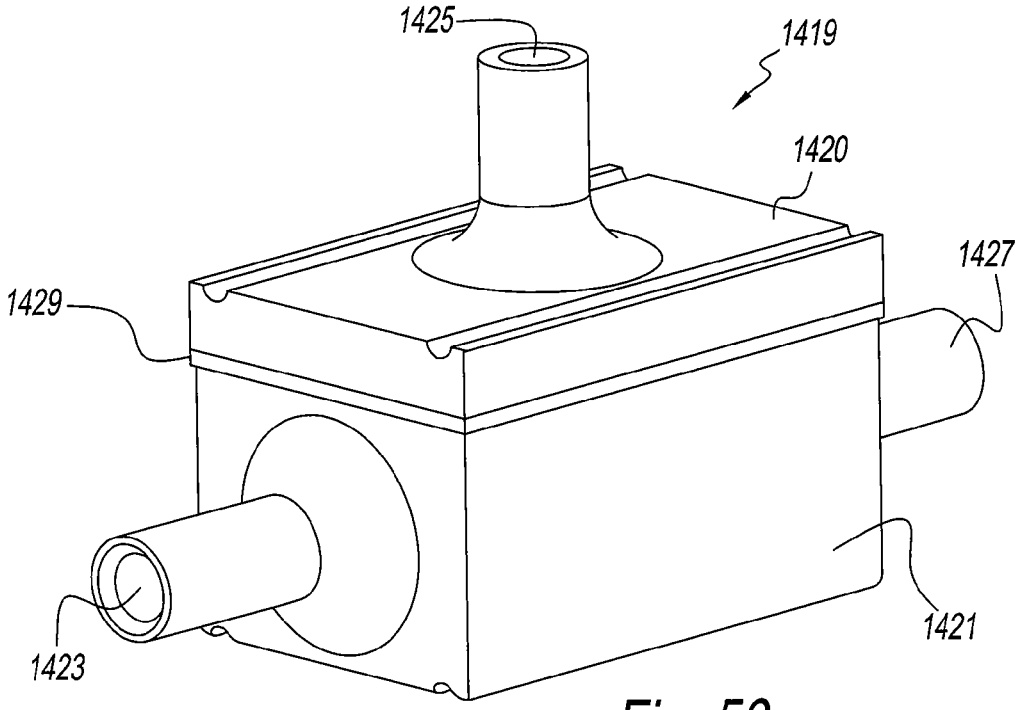
FIG. 56 is a front top perspective view of the non-return valve of FIG. 55.
Figure 57:
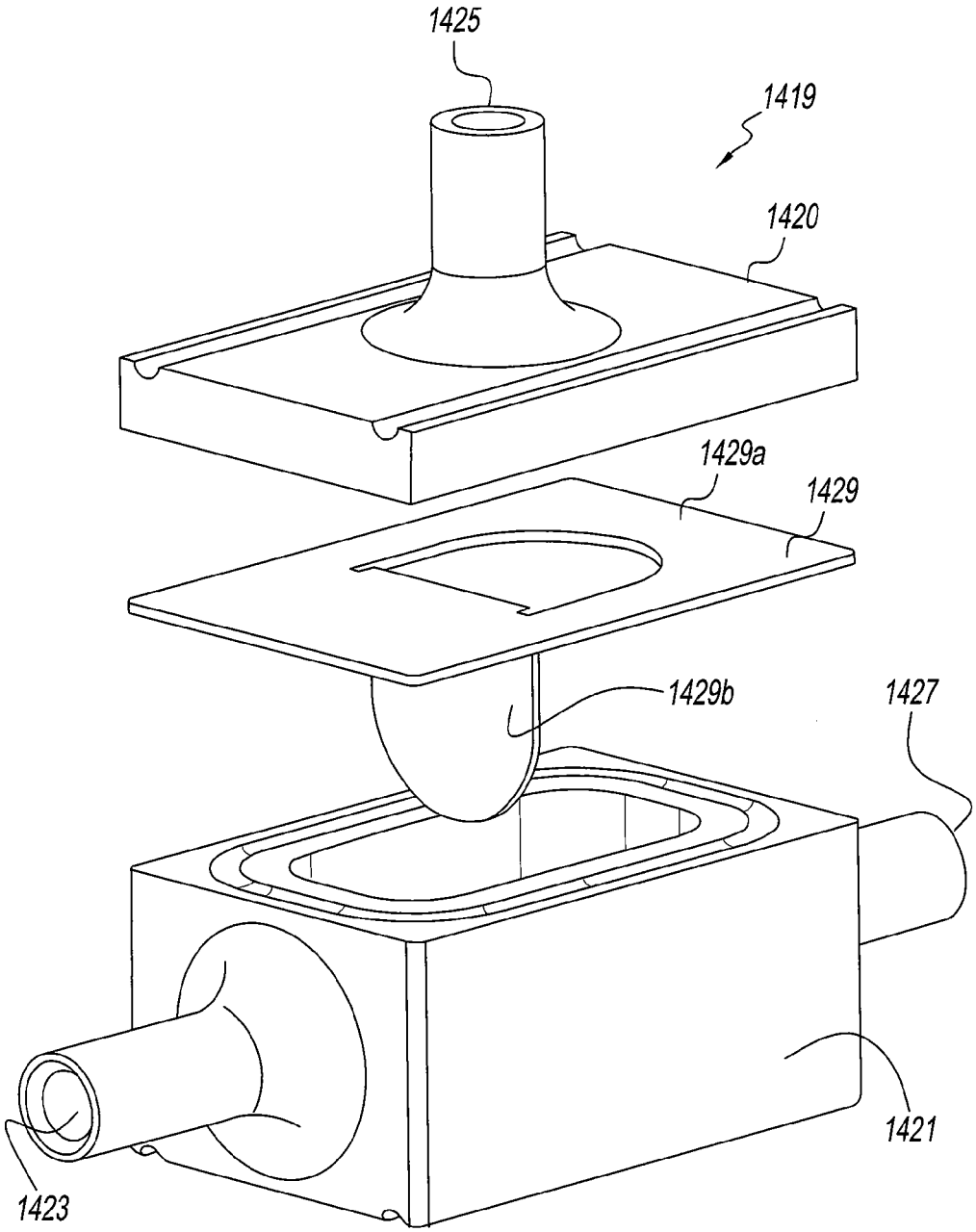
FIG. 57 an exploded view of the non-return valve of FIG. 55.

FIGS. 55-57 are views of a non-return valve according to the present disclosure referred to by reference numeral 1419. Non-return valve 1419 has a top housing 1420, a bottom housing 1421, and a moveable member 1429. As shown in FIG. 57, moveable member 1429 has a flat portion 1429*a* and a moveable flap 1429*b*. Bottom housing 4021 has a syrup inlet 1423 and product outlet 1427 to LMS valve 3003. Top housing 1420 has $CO_2$/air inlet 1425. Similar to expansion valve 3019, non-return valve 1419 may be connected to line conduit 1130 in flavor/ingredient dispensing module 1100 so that first portion 1130*a* of line conduit 1130 is connected to syrup inlet 1423 upstream of non-return valve 1419, second portion 1130*b* of line conduit 1130 is connected to product outlet 1427 downstream of non-return valve 1419, and conduit 5056 is connected to $CO_2$/air inlet 1425. However, valve 5052 in this embodiment only includes a solenoid that opens a first passage for the $CO_2$/air to pass into conduit 5054 in a first position and closes a second passage for the $CO_2$/air to pass into conduit 5056 in the first position and closes the first passage for the $CO_2$/air to pass into conduit 5054 in the second position while opening the second passage for the $CO_2$/air to pass into conduit 5056 in the second position. Top housing 1420 is connected to bottom housing 1421 with flat portion 1429*a* of moveable member 1429 secured between top housing 1420 and bottom housing 1421, for example, by screws.

Figure 58:
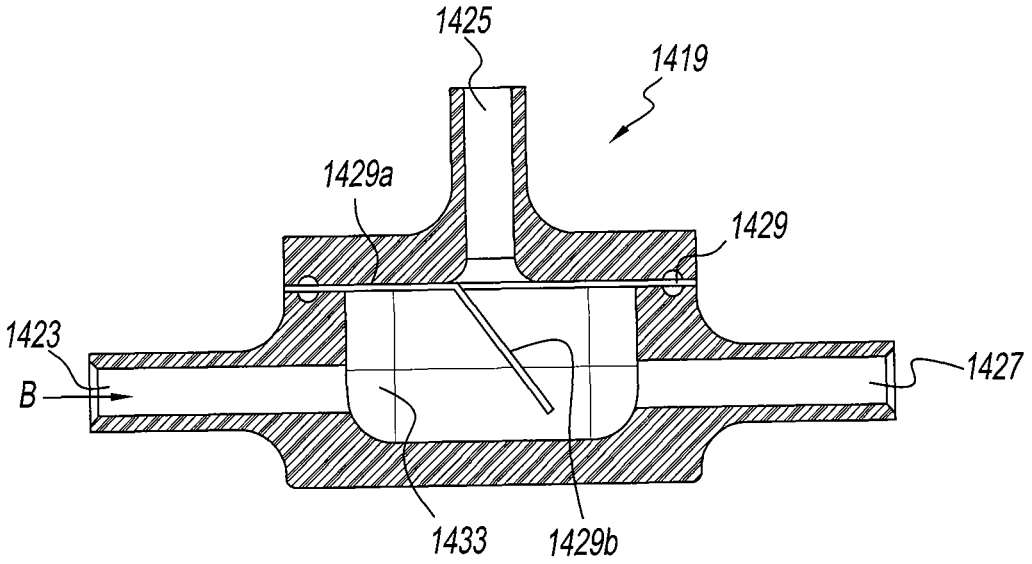
FIG. 58 is a side cross sectional view of the non-return valve of FIG. 55 when ingredients are flowing through the non-return valve.

As shown in FIG. 58, moveable member 1429 is secured to top housing 1420 and bottom housing 1421 so that moveable flap 1429*b* extends into an ingredient chamber or conduit 1433 of non-return valve 1419. Moveable flap 1429*b* is a flexible material that can be moved toward top housing 1420 and away from top housing 1420. Ingredients are pumped into syrup inlet 1423, as shown by arrow B, and moveable flap 1429*b* is pushed towards top housing 1420 by the ingredients so that the ingredients can pass through syrup inlet 1423 to product outlet 1427.

Figure 59:
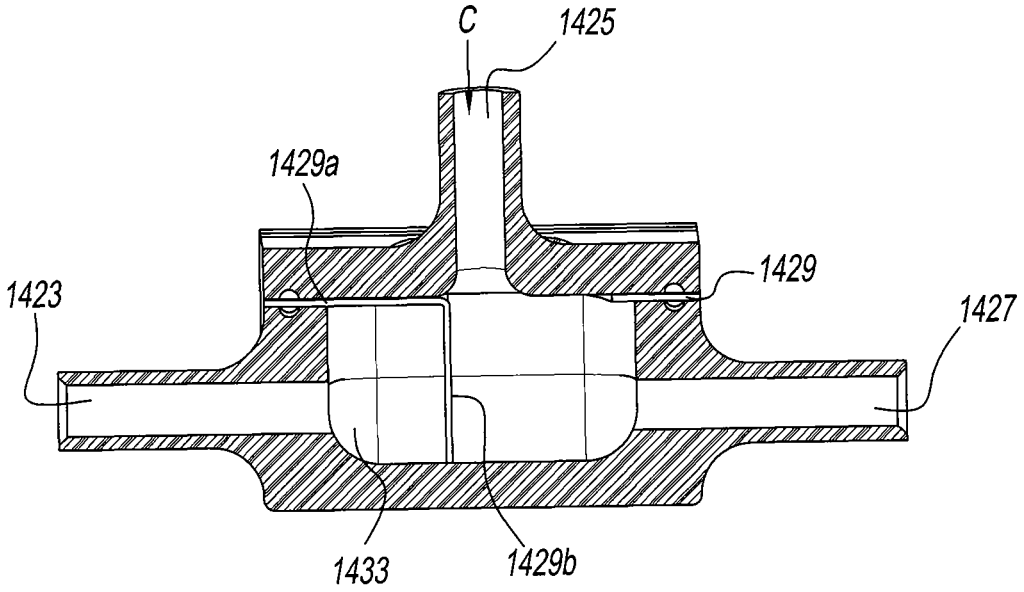
FIG. 59 is a side cross sectional view of the non-return valve of FIG. 55 when the non-return valve is sealed.

As shown in FIG. 59, where the system 3011, or valve 5052, terminates the pumping of ingredients through syrup inlet 1423, $CO_2$/air is flowed through $CO_2$/air inlet 1425, as shown by arrow C, so that moveable flap 1429*b* seals ingredient chamber or conduit 1433 blocking further flow of the ingredients out of product outlet 1427.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A beverage system comprising:

an ingredient module; and an ingredient dispensing valve in communication with the ingredient module, the ingredient dispensing valve dispensing an ingredient into a beverage container, wherein the ingredient module comprises a housing, an ingredient container disposed within the housing, a first ingredient conduit disposed between the ingredient container and the ingredient dispensing valve, and a pumping device that causes the ingredient to move from the ingredient container, through the first ingredient conduit, and through the ingredient dispensing valve under pressure, a valve which receives the ingredient from the pumping device and passes the ingredient to the dispensing valve, wherein the valve includes a second ingredient conduit, wherein the valve controls the size of the second ingredient conduit, such that the size of the second ingredient conduit is reduced during dispensing of the ingredient to the dispensing valve and enlarged when the dispensing of the ingredient to the dispensing valve is terminated.

2. The system of claim 1, wherein the valve has a first inlet and an outlet, and wherein the first ingredient conduit has a first portion connected to the first inlet upstream of the valve and the first ingredient conduit has a second portion connected to the outlet downstream of the valve.

3. The system of claim 2, wherein the valve has a diaphragm that moves within the second ingredient conduit to reduce and enlarge the size of the second ingredient conduit.

4. The system of claim 3, wherein the valve has a housing forming the second ingredient conduit therein, and wherein the housing has an internal boss restricting movement of the diaphragm while allowing a fluid passageway around the internal boss.

5. The system of claim 3, wherein the diaphragm in the valve is controlled by the passing of pressurized $CO_2$ and/or air to a surface of the diaphragm opposite to the second ingredient conduit.

6. The system of claim 2, wherein the valve has a top housing, a bottom housing and a membrane secured between the top housing and bottom housing, and wherein the top housing has a second inlet to selectively receive pressurized $CO_2$ and/or air so that the membrane inflates within the second ingredient conduit to reduce the size of the second ingredient conduit when the second inlet receives pressurized $CO_2$ and/or air and deflates to enlarge the size of the second ingredient conduit when the second inlet does not receive pressurized $CO_2$ and/or air.

7. The system of claim 6, wherein the second ingredient conduit, the first inlet and the outlet are in the bottom housing.

8. The system of claim 2, wherein the valve has a casing having an inner chamber in fluid communication with the second ingredient conduit, and wherein the casing has a piston movable from a first position to a second position in the inner chamber so that the first position reduces the size of the second ingredient conduit and the second position enlarges the size of the second ingredient conduit.

9. The system of claim 2, wherein the valve has a housing with a flexible tube in the housing forming the second ingredient conduit, and wherein the valve has a second inlet in the housing that receives pressurized $CO_2$ and/or air to compress the flexible tube to reduce the size of the second ingredient conduit when the second inlet receives pressurized $CO_2$ and/or air and the second ingredient conduit is enlarged when the second inlet does not receive pressurized $CO_2$ and/or air.

10. The system of claim 2, wherein the valve has a housing with a flexible tube in the housing forming the second ingredient conduit and a member adjacent the flexible tube, and wherein the member is moved by a pneumatic cylinder to compress flexible tube to reduce the size of the second ingredient conduit and the size of the second ingredient conduit is enlarged when the member is moved by the pneumatic cylinder away from the flexible tube.

11. A beverage system comprising:

an ingredient module; and an ingredient dispensing valve in communication with the ingredient module, the ingredient dispensing valve dispensing an ingredient into a beverage container, wherein the ingredient module comprises a housing, an ingredient container disposed within the housing, a first ingredient conduit disposed between the ingredient container and the ingredient dispensing valve, and a pumping device that causes the ingredient to move from the ingredient container, through the first ingredient conduit, and through the ingredient dispensing valve under pressure, a valve which receives the ingredient from the pumping device and passes the ingredient to the dispensing valve, wherein the valve has a top housing, a bottom housing and a moveable member secured between the top housing and bottom housing, and wherein the top housing has an inlet to selectively receive pressurized $CO_2$ and/or air so that the moveable member that has a flap extends into a second ingredient conduit when the inlet receives pressurized $CO_2$ and/or air and moves toward the top housing to enlarge the size of the second ingredient conduit when the inlet does not receive pressurized $CO_2$ and/or air.

12. A method for controlling an ingredient in a beverage system comprising:

dispensing the ingredient from an ingredient module into a beverage container via an ingredient dispensing valve, the ingredient module comprising a housing, an ingredient container disposed within the housing, a first ingredient conduit disposed between the ingredient container and the ingredient dispensing valve, and a pumping device that causes the ingredient to move from the ingredient container, through the first ingredient conduit, and through the ingredient dispensing valve under pressure, a valve which receives the ingredient from the pumping device and passes the ingredient to the dispensing valve, wherein the valve includes a second ingredient conduit;

controlling the size of the second ingredient conduit by the valve, such that the size of the second ingredient conduit is reduced during dispensing of the ingredient to the dispensing valve and enlarged when the dispensing of the ingredient to the dispensing valve is terminated.

* * * * *